US008867934B2

(12) United States Patent
Itoyama et al.

(10) Patent No.: US 8,867,934 B2
(45) Date of Patent: Oct. 21, 2014

(54) METHOD FOR JUDGING TONER SHORTAGE AND IMAGE FORMING APPARATUS

(75) Inventors: Motoyuki Itoyama, Osaka (JP); Kazuma Hinoue, Osaka (JP); Hideji Saikoh, Osaka (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 316 days.

(21) Appl. No.: 13/372,856

(22) Filed: Feb. 14, 2012

(65) Prior Publication Data

US 2012/0207490 A1 Aug. 16, 2012

(30) Foreign Application Priority Data

Feb. 16, 2011 (JP) ..... 2011-030622

(51) Int. Cl.
*G03G 15/08* (2006.01)
*G03G 15/00* (2006.01)

(52) U.S. Cl.
CPC ..... *G03G 15/556* (2013.01); *G03G 15/0893* (2013.01); *G03G 15/086* (2013.01); *G03G 2215/0609* (2013.01)
USPC ..... 399/30

(58) Field of Classification Search
CPC ..... G03G 15/0829; G03G 15/0853; G03G 2215/0888
USPC ..... 399/27, 30, 61–63
See application file for complete search history.

(56) References Cited

U.S. PATENT DOCUMENTS

| | | | | |
|---|---|---|---|---|
| 5,214,476 | A * | 5/1993 | Nomura et al. | 399/30 |
| 6,006,050 | A * | 12/1999 | Watanabe et al. | |
| 7,444,093 | B2 * | 10/2008 | Abe et al. | |
| 2007/0196116 | A1 * | 8/2007 | Watanabe | 399/30 |
| 2011/0255888 | A1 * | 10/2011 | Itoyama et al. | 399/30 |

FOREIGN PATENT DOCUMENTS

| | | |
|---|---|---|
| JP | 4-152371 | 5/1992 |
| JP | 2006-106194 | 4/2006 |
| JP | 2011-002771 | 1/2011 |

* cited by examiner

*Primary Examiner* — Walter L Linsday, Jr.
*Assistant Examiner* — Milton Gonzalez
(74) *Attorney, Agent, or Firm* — Nixon & Vanderhye, P.C.

(57) ABSTRACT

The image forming apparatus carries out a monitoring operation in which (i) sensor outputs of the magnetic permeability sensor are periodically sampled, (ii) a time period, corresponding to one (1) circulation period which is required for the developer to be circulated once in the circulation carrying path, is evenly divided into a plurality of blocks, and (iii) an average of the sensor outputs in one (1) block time period corresponding to one (1) block is calculated for each of the plurality of blocks; and determines that toner has run short, in a case where the number of times that the averages of the sensor outputs consecutively exceed a threshold, set to be higher than a reference value of the sensor outputs, becomes not less than the number of the plurality of blocks which correspond to the time period corresponding to one (1) circulation period.

16 Claims, 23 Drawing Sheets

FIG. 14

| AMOUNT OF REMAINING TONER | COUNTER | ADDITIONAL VALUE | DETERMINATION VALUE |
|---|---|---|---|
| >25% | w | 3 | 50 |
| | x | 8 | 30 |
| | y | 16 | 10 |
| ≦25% | w | 1 | 50 |
| | x | 5 | 30 |
| | y | 8 | 10 |

FIG. 20

(a)
WHEN POWER SOURCE IS TURNED OFF

| SEQUENCE | 1 | 2 | 3 | 4 | 5 | 6 | 7 | 8 | 9 | 10 |
|---|---|---|---|---|---|---|---|---|---|---|
| DATA | 128 | 125 | 126 | 130 | 127 | 128 | 124 | 123 | 129 | 127 |

(b)

| AVERAGE | REMAINDER |
|---|---|
| 126 | 7 |

(c)
WHEN POWER SOURCE IS TURNED ON

| SEQUENCE | 1 | 2 | 3 | 4 | 5 | 6 | 7 | 8 | 9 | 10 |
|---|---|---|---|---|---|---|---|---|---|---|
| DATA | 127 | 127 | 127 | 127 | 127 | 127 | 127 | 126 | 126 | 126 |

METHOD FOR JUDGING TONER SHORTAGE AND IMAGE FORMING APPARATUS

This Nonprovisional application claims priority under 35 U.S.C. §119(a) on Patent Application No. 2011-030622 filed in Japan on Feb. 16, 2011, the entire contents of which are hereby incorporated by reference.

TECHNICAL FIELD

The present invention relates to an image forming apparatus. In particular, the present invention relates to an image forming apparatus which includes a developing device using two-component developer containing toner and magnetic carrier. Examples of the image forming apparatus encompass an electro-static copying machine, a laser printer, and a facsimile, each of which forms an image with the use of toner by an electrophotographic printing method. The present invention further relates to a method for determining toner shortage, which method is carried out by an image forming apparatus.

BACKGROUND ART

Conventionally, an electrophotographic printing image forming apparatus, such as a copying machine, a printer, or a facsimile, has been known. According to such an electrophotographic printing image forming apparatus, an electrostatic latent image is formed on a surface of a photoreceptor (e.g., photoreceptor drum), and toner is supplied to the photoreceptor drum by a developing device so that the electrostatic latent image is developed. After that, the toner image formed by the developing on the photoreceptor drum is (i) transferred onto a sheet such as paper and then (ii) fixed on the sheet by a fixing device.

In recent years, an image forming apparatus, which deals with full color images with high image quality, uses two-component developer (hereinafter, simply referred to as "developer") because of excellence in stabile electrostatic property of toner.

Such a developer contains toner and carrier, which are stirred in a developing device so as to be rubbed together, and such friction provides properly charged toner.

The toner charged in the developing device is supplied to a surface of a two-component developer holding member such as a developing roller. The toner supplied to the developing roller is moved, by electrostatic attractive force, to an electrostatic latent image formed on the photoreceptor drum. Consequently, a toner image is formed on the photoreceptor drum in accordance with the electrostatic latent image.

Recently, an image forming apparatus has been demanded to operate at a higher speed and to be reduced in size. In order to meet such demands, it is becoming necessary (i) to charge the developer quickly and sufficiently and also (ii) to carry the developer quickly.

Under the circumstances, some image forming apparatuses are configured to include a circulating developing device in which supplied toner is immediately dispersed in developer so that an appropriate amount of charge can be obtained.

Such a circulating developing device includes (i) a developer carrying path through which developer is carried to circulate, (ii) a screw auger (developer carrying member) which stirs and carries the developer in the developer carrying path, (iii) a toner supply inlet through which toner is supplied from a toner storing section into the developer carrying path, and (iv) a toner density detecting sensor which detects a toner density of the developer. In the circulating developing device, in a case where the toner density of the developer becomes lower than a predetermined value, toner is supplied to the developer carrying path in response to an instruction, to a cartridge, on supplying a toner, and the supplied tone is to be carried while the developer is stirred (see Patent Literature 1).

Moreover, a developing device has been proposed in which, in order to maintain stable toner density by supplying toner, toner is supplied from a toner storing section into a developer carrying path based on an amount of toner, which is to be consumed in forming an image, predicted by the use of a dot-counting device. In the developing device, toner empty (toner shortage), in which toner to be supplied does not remain in the toner storing section, is detected by a toner density sensor which is made up of a magnetic permeability sensor and is provided near a toner supply inlet (see Patent Literature 2).

CITATION LIST

Patent Literature

Patent Literature 1
Japanese Patent Application Publication Tokukai No. 2006-106194 A (Publication date: Apr. 20, 2006)
Patent Literature 2
Japanese Patent Application Publication Tokukai No. 2011-2771 A (Publication date: Jan. 6, 2011)

SUMMARY OF INVENTION

Technical Problem

In the circulating developing device which uses two-component developer, in a case where toner to be supplied from the toner storing section into the developer carrying path has run short, a toner density of the developer is gradually decreased, and carrier developing (carrier adhesion) becomes more likely to occur. In order to address this, it is necessary to detect a state where toner to be supplied has run short (i.e., toner empty).

Such a toner empty is determined (detected) by, for example, detecting that no toner has supplied, based on a fact that a toner density of the developer detected by the toner density sensor is not raised, in spite of an instruction on supplying toner made by the toner storing section.

Patent Literature 2 discloses a configuration to detect toner empty by the use of the toner density detecting sensor provided near the toner supply inlet. With the configuration, it is possible to detect whether or not toner has supplied by monitoring change in sensor output immediately after the instruction on supplying toner has been made. In a case where the sensor output is not changed, it is possible to determine that no toner has been supplied, i.e., toner empty has occurred. This allows toner empty to be detected without delay.

However, for various reasons such as design restrictions, the toner density detecting sensor sometimes cannot be located near the toner supply inlet. In such a case, it is impossible to directly detect whether or not toner has been supplied by monitoring a change in sensor output immediately after the instruction on supplying toner has been made. This causes delay in detection of toner empty, and it is therefore not possible to solve the problem that carriers are more frequently adhered to a photoreceptor.

The present invention is accomplished in view of the conventional problem, and its object is to provide an image forming apparatus and a method for determining toner shortage each of which (i) can detect toner empty (i.e., a state where toner to be supplied has run short) without delay, even in a case where a toner density detecting sensor is located away from a toner supply inlet, and therefore (ii) can suppress an occurrence of carriers being adhered to a photoreceptor due to a decrease in toner density.

Solution to Problem

In order to attain the object, a method for determining a toner shortage of the present invention is a method for determining a toner shortage for use in an image forming apparatus, the image forming apparatus including a developing device in which toner is supplied into a circulation carrying path through a toner supply inlet which is located in a part of the circulation carrying path in which developer, containing toner and magnetic carrier, is circulated and carried, the method determining that toner to be supplied has run short, by use of a sensor output of a magnetic permeability sensor which detects a magnetic permeability of the developer which is circulated and carried through the circulation carrying path, the method including the steps of: carrying out a monitoring operation, in which (i) sensor outputs of the magnetic permeability sensor are periodically sampled, (ii) a time period, corresponding to one (1) circulation period which is required for the developer to be circulated once in the circulation carrying path, is evenly divided into a plurality of blocks, and (iii) an average of the sensor outputs in one (1) block time period corresponding to one (1) block is calculated for each of the plurality of blocks; and determining that the toner has run short, in a case where the number of times that the averages of the sensor outputs consecutively exceed a threshold becomes not less than the number of the plurality of blocks which correspond to the time period corresponding to one (1) circulation period, the threshold being set to be higher than a reference value of the sensor outputs of the magnetic permeability sensor.

According to the configuration, the monitoring operation is carried out in which (a) the time period corresponding to one (1) circulation period is evenly divided in to the plurality of blocks, and (b) an average (block average) of the sensor outputs in one (1) block time period corresponding to one (1) block is calculated for each of the plurality of blocks. By carrying out the monitoring operation, it is possible to grasp, for each of the plurality of blocks, a toner density of the developer circulated and carried in the circulation carrying path.

Moreover, the number of times (corresponding to the number of blocks in which block averages consecutively exceed the threshold) is measured that the block averages, calculated for the respective of the plurality of blocks, consecutively exceed the threshold set to be higher than the reference value of the sensor outputs of the magnetic permeability sensor.

The state where the block averages for the respective plurality of blocks consecutively exceed the threshold indicates a state where toner supply is not detected although toner needs to be supplied. In such a state, toner is most likely to have run short.

The fact that the threshold is not consecutively exceeded under the circumstances means that a block average became not higher than the threshold. This is because low magnetic permeability of the developer which is located in a region where supplied toner was unevenly distributed, was detected. It is therefore possible to determine that toner to be supplied remains (i.e., toner has not run short).

In view of the circumstances, toner empty is detected, in a case where the number of times that the block averages for the respective plurality of blocks exceed the threshold becomes not less than the number of blocks corresponding to at least one (1) circulation period. That is, it is determined that the toner to be supplied has run short, i.e., toner empty is detected, in a case where toner needs to be immediately supplied but a toner supply is not detected while the developer circulates once in the circulation carrying path.

As such, according to the method of the present invention for determining toner shortage, toner shortage is detected, in a case where toner needs to be supplied but toner supply is not detected during a predetermined period which is set depending on the threshold and is long enough for determining the toner shortage.

According to the detection of toner empty, it is possible to detect toner shortage without delay by appropriately setting a time width of each of the plurality of blocks, the threshold, and the determination value based on which the toner shortage is determined, regardless of a positional relation between the toner supply inlet and the magnetic permeability sensor.

In order to attain the object, an image forming apparatus of the present invention includes: a developing device which includes (i) a developer storing section in which developer containing toner and magnetic carrier is stored, (ii) a developer carrying member which stirs and carries the developer so as to circulate the developer in the developer storing section, (iii) a developing roller which supplies the toner contained in the developer to a photoreceptor drum, and (iv) a toner supply inlet through which toner is supplied into the developer storing section, the toner supply inlet being located in a part of a circulation carrying path in the developer storing section; a toner supply device which supplies toner to the developing device; a magnetic permeability sensor which detects a magnetic permeability of the developer which is circulated and carried in the developer storing section by the developer carrying member; and a monitoring/detecting section which periodically samples an output of the magnetic permeability sensor so as to detect toner shortage in the toner supply device based on a sampled output, the monitoring/detecting section including: a block average calculating section which (i) periodically samples sensor outputs of the magnetic permeability sensor, (ii) evenly divides, into a plurality of blocks, a time period corresponding to one (1) circulation period which is required for the developer to be circulated once in the circulation carrying path, and (iii) calculates an average of the sensor outputs in one (1) block time period corresponding to one (1) block for each of the plurality of blocks, a measuring section which measures the number of times that block averages, calculated by the block average calculating section, have consecutively exceeded a threshold which is an addition of a predetermined value and a reference value of the sensor outputs of the magnetic permeability sensor, and a toner shortage determining section which determines that the toner has run short, in a case where the number of times that the measuring section has measured reaches a predetermined determination value which is not less than the number of the plurality of blocks which correspond to a time period corresponding to one (1) circulation period.

According to the configuration, the monitoring/detecting section periodically samples sensor outputs of the magnetic permeability sensor and detects toner shortage in the toner supply device based on sampled sensor outputs. Here, the monitoring/detecting section includes the block average calculating section, the measuring section, and the toner shortage determining section. The block average calculating section (i) periodically samples sensor outputs of the magnetic permeability sensor, (ii) evenly divides, into the plurality of blocks, the time period corresponding to one (1) circulation period which is required for the developer to be circulated once in the circulation carrying path, and (iii) calculates a block average, which is an average of the sensor outputs in one (1) block time period corresponding to one (1) block for each of the plurality of blocks. The measuring section measures the number of times that the block averages, calculated by the block average calculating section, have consecutively exceeded the threshold which is an addition of a predetermined value and the reference value of the sensor outputs of the magnetic permeability sensor. The toner shortage determining section determines that the toner has run short, in a case where the number of times that the measuring section has measured reaches the predetermined determination value which is not less than the number of the plurality of blocks which correspond to the time period corresponding to one (1) circulation period.

According the image forming apparatus of the present invention, as with the method for determining toner shortage, it is possible to detect toner shortage without delay by appropriately setting a time width of each of the plurality of blocks, the threshold, and the determination value based on which the toner shortage is determined, regardless of a positional relation between the toner supply inlet and the magnetic permeability sensor. It is therefore possible to suppress an occurrence of carriers being adhered to the photoreceptor due to a decrease in toner density.

Advantageous Effects of Invention

According the present invention, it is possible to provide the image forming apparatus which can detect toner shortage without delay by appropriately setting a time width of each of the plurality of blocks, the threshold, and the determination value based on which the toner shortage is determined, regardless of a positional relation between the toner supply inlet and the magnetic permeability sensor. It is therefore possible to (i) detect toner shortage without delay, even in a case where the toner density detecting sensor is located away from the toner supply inlet, and (ii) suppress an occurrence of carriers being adhered to the photoreceptor due to a decrease in toner density.

BRIEF DESCRIPTION OF DRAWINGS

FIG. 14 is a view illustrating contents of a determination table used by a toner empty determining section of the toner empty detecting section.

FIG. 20 Each of (a) through (c) of FIG. 20 is a view for explaining how a TCS_Ave storing section, included in the image forming apparatus of the another embodiment, stores a TCS_Ave.

DESCRIPTION OF EMBODIMENTS

Embodiment 1

The following description will discuss an embodiment of the present invention with reference to drawings.

Figure 2:
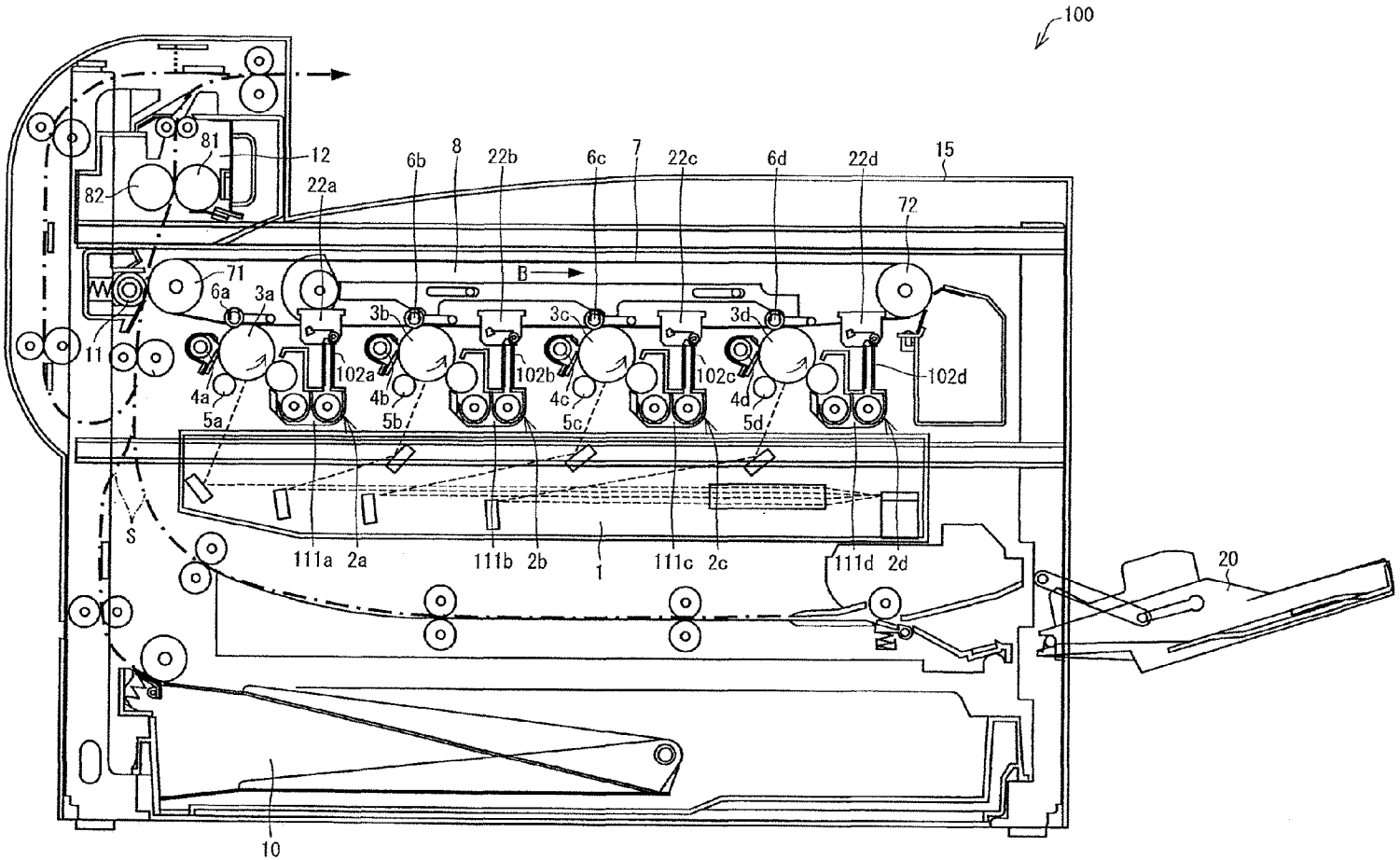
FIG. 2 is an explanatory view illustrating an overall configuration of the image forming apparatus.

FIG. 2 is an explanatory view illustrating an entire configuration of an example of an image forming apparatus in accordance with an embodiment of the present invention.

The present embodiment employs a characteristic configuration of the present invention in an image forming apparatus 100 of an electrophotographic type which forms an image by the use of toner.

The image forming apparatus 100 forms a multicolor image or a monochrome image on a predetermined sheet (recording paper, recording medium) in accordance with externally supplied image data. Note that a device such as a scanner can be further provided above the image forming apparatus 100.

The following description will briefly discuss an overall configuration of the image forming apparatus 100.

The image forming apparatus 100 (i) processes pieces of image data for respective color components of black (K), cyan (C), magenta (M), and yellow (Y), (ii) forms a black image, a cyan image, a magenta image, and a yellow image, and (iii) forms a color image by superimposing the images having the respective color components.

In order to deal with the color components, the image forming apparatus 100 includes four developing devices 2 (2*a*, 2*b*, 2*c*, and 2*d*), four photoreceptor drums 3 (3*a*, 3*b*, 3*c*, and 3*d*), four chargers 5 (5*a*, 5*b*, 5*c*, and 5*d*), and four cleaner units 4 (4*a*, 4*b*, 4*c*, and 4*d*) (see FIG. 2).

Note that, members, to each of which the reference symbol "a" is given, relate to black, members, to each of which the reference symbol "b" is given, relate to cyan, members, to each of which the reference symbol "c" is given, relate to magenta, and members, to each of which the reference symbol "d" is given, relate to yellow. The image forming apparatus 100 further includes an exposure unit 1, a fixing unit 12, a sheet carrying path S, a paper feeding tray 10, and a paper output tray 15.

The charger 5 evenly charges a surface of the photoreceptor drum 3 by applying a predetermined electric potential to the surface.

The exposure unit 1 exposes the photoreceptor drum 3, whose surface has been charged, in accordance with supplied image data so as to form an electrostatic latent image on the surface of the photoreceptor drum 3 in accordance with the supplied image data.

The developing devices 2 (2*a*, 2*b*, 2*c*, and 2*d*) make visible respective electrostatic latent images, which have been formed on the respective photoreceptor drum 3 (3*a*, 3*b*, 3*c*, and 3*d*) (i.e., the developing devices 2 develop the respective electrostatic latent images) with the use of toners of the respective colors K, C, M, and Y. The developing devices 2 (2*a*, 2*b*, 2*c*, and 2*d*) include respective developing tanks (developer containing section) 111 (111*a*, 111*b*, 111*c*, and 111*d*). Toner transfer mechanisms 102 (102*a*, 102*b*, 102*c*, and 102*d*) and toner supplying devices 22 (22*a*, 22*b*, 22*c*, 22*d*) are provided above the respective developing devices 2 (2*a*, 2*b*, 2*c*, and 2*d*).

The toner supplying devices 22 are provided above the respective developing tanks 111 and store unused toner (powdery toner). The toner supplying device 22 supplies the toner to the developing tank 111, via the toner transfer mechanism 102.

The cleaner units 4 remove and retrieve toner remaining on surfaces of the respective photoreceptor drums 3 after a developing process and an image transferring process.

An intermediate transfer belt unit 8 is provided above the photoreceptor drums 3 (3*a*, 3*b*, 3*c*, and 3*d*). The intermediate transfer belt unit 8 includes intermediate transfer rollers 6 (6*a*, 6*b*, 6*c*, and 6*d*), an intermediate transfer belt 7, an intermediate transfer belt driving roller 71, and an intermediate transfer belt driven roller 72.

The intermediate transfer belt 7 is driven to rotate, by the intermediate transfer belt driving roller 71, in a direction indicated by an arrow B in FIG. 2. A transfer bias voltage is applied to the intermediate transfer rollers 6 so that toner images on the respective photoreceptor drums 3 can be transferred onto the intermediate transfer belt 7.

The toner images of the respective color components, which have been formed on the respective photoreceptor drums 3 (3*a*, 3*b*, 3*c*, and 3*d*), are sequentially transferred onto the intermediate transfer belt 7 such that the toner images are superimposed on the intermediate transfer belt 7. This causes a colored toner image (multicolor toner image) to be formed. The intermediate transfer belt 7 is rotated so that superimposed toner images are moved to a contact location (transfer section) in which the intermediate transfer belt 7 contacts with a sheet carried to the contact location. The toner images are then transferred, by a transfer roller 11 provided in the contact location, onto a sheet which has been fed from the paper feeding tray 10 or from a manual paper feeding tray 20 via a corresponding sheet carrying path S.

The fixing unit 12 includes a heating roller 81 and a pressure roller 82. A sheet, on which toner images of respective colors have been transferred, passes, receives heat, and is pressured between the heating roller 81 and the pressure roller 82. This causes the toner images of respective colors to be melted, mixed, and pressed by the heating roller 81 and the pressure roller 82. As such, the toner images of respective colors are fixed onto the sheet. Then, the sheet, on which a multicolor toner image (i.e., the toner images of respective colors) is fixed, is carried through a reverse paper output path, and the sheet is then discharged onto the paper output tray 15 while the sheet is being in a reversed state.

The following description will concretely discuss a configuration of the toner supplying devices 22 in accordance with the present embodiment.

Figure 3:
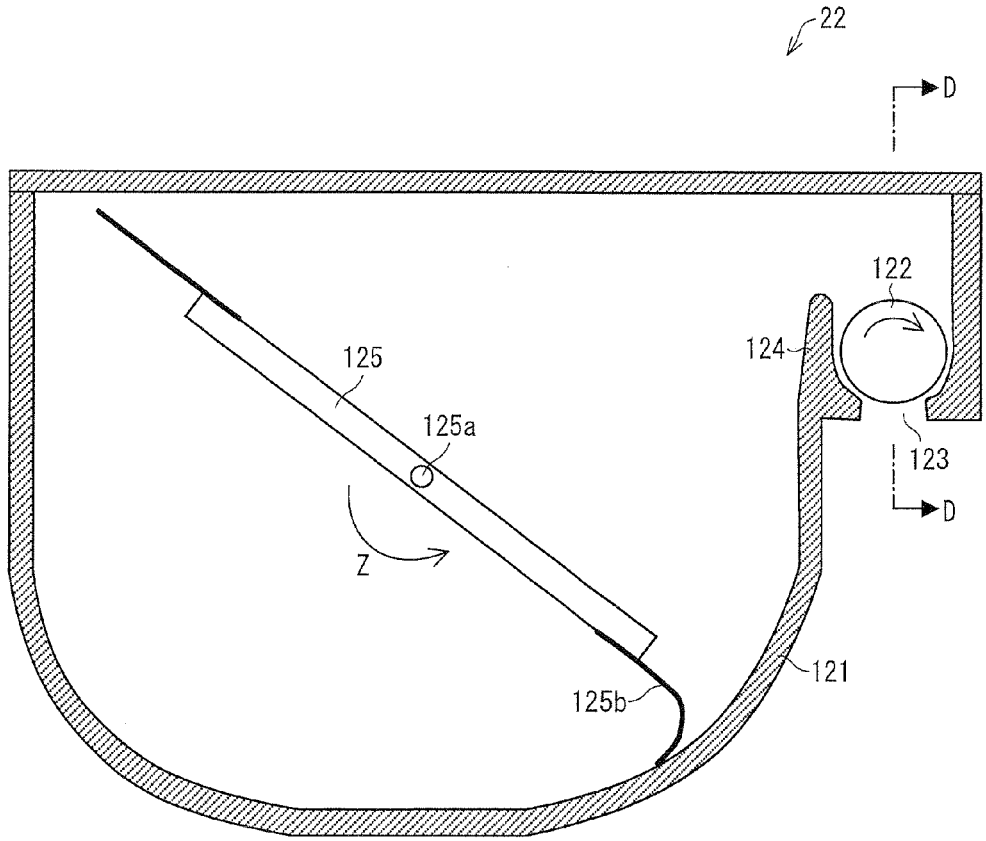
FIG. 3 is a cross sectional view schematically illustrating a configuration of a toner supply device included in the image forming apparatus.
Figure 4:
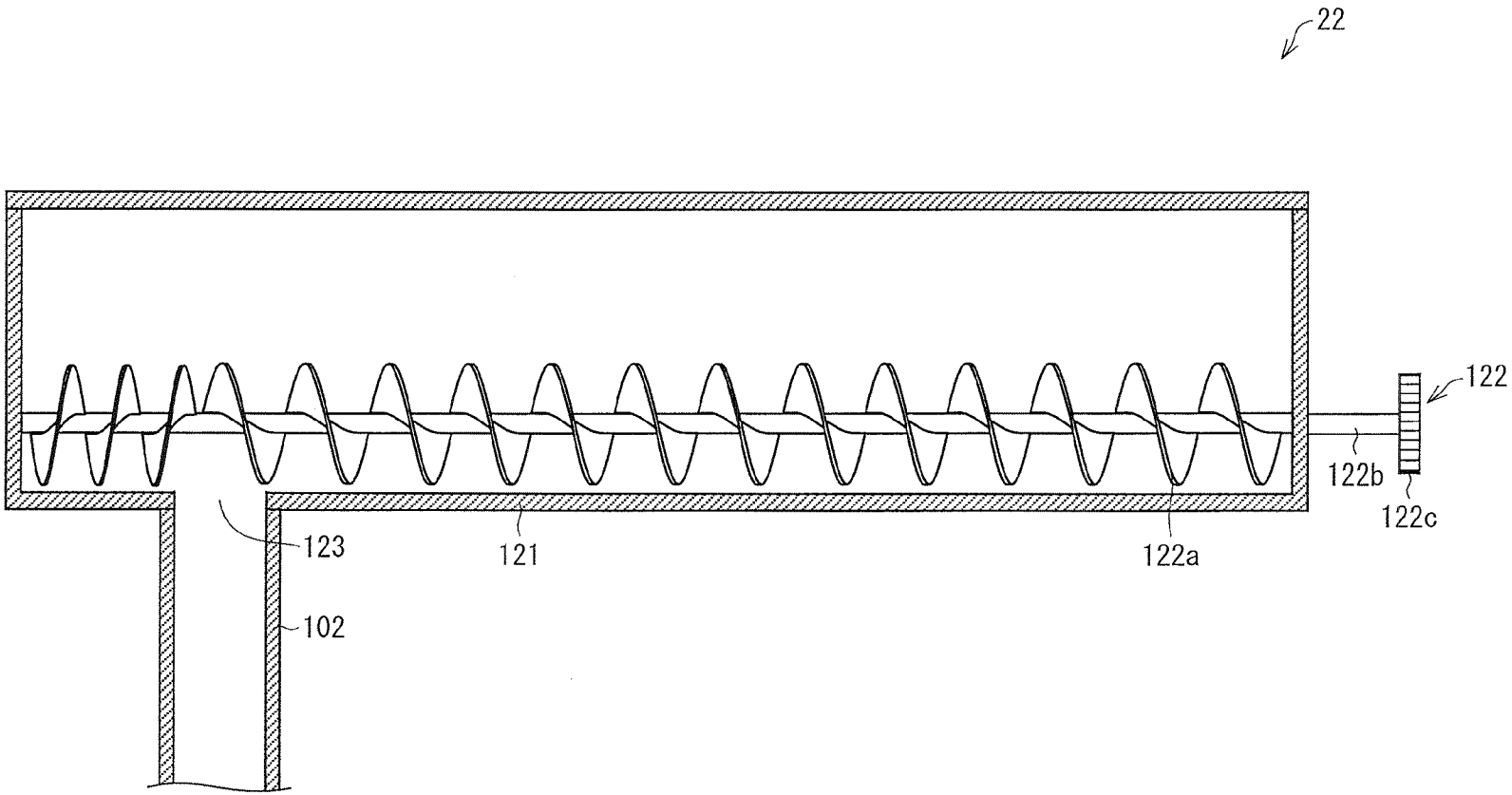
FIG. 4 is a cross sectional view taken along the line D-D of FIG. 3.

FIG. 3 is a cross sectional view schematically illustrating a toner supplying device included in the image forming apparatus of the present embodiment. FIG. 4 is a cross sectional view taken along the line D-D of FIG. 2.

The toner supplying device 22 includes a toner container 121, a toner stirring member 125, a toner discharging member 122, and a toner discharge opening 123 (see FIGS. 3 and 4). The toner supplying device 22 is provided above the developing tank 111 (see FIG. 2), and stores unused toner (powdery toner). The toner discharging member (discharging screw) 122 is rotated so that the toner stored in the toner supplying device 22 is supplied from the toner discharge opening 123 to the developing tank 111, via the toner transfer mechanism 102.

The toner container 121 is a container, having internal space, whose shape is substantially semi-cylindrical. The toner container 121 rotatably supports the toner stirring member 125 and the toner discharging member 122, and contains toner. The toner discharge opening 123 is an opening having a substantially rectangular shape and is provided below the toner discharging member 122 so as to be closer to one end side in an axial direction of the toner discharging member 122. The toner discharge opening 123 is provided so as to be brought into communication with the toner transfer mechanism 102 (see FIG. 2).

The toner stirring member 125 is a plate member which is rotated about a rotary shaft 125*a* so as to (i) stir and scoop up toner contained in the toner container 121 and (ii) carry the toner to the toner discharging member 122. The toner stirring member 125 has toner scooping members 125*b* which are provided at both ends of the toner stirring member 125. Each of the toner scooping members 125*b* is made of a flexible polyethylene terephthalate (PET) sheet.

The toner discharging member 122 supplies the toner, contained in the toner container 121, to the developing tank 111 via the toner discharge opening 123. The toner discharging member 122 includes (i) a screw auger which is made up of a toner carrying blade 122*a* and a toner discharging member rotary shaft 122*b* and (ii) a toner discharging member rotary gear 122*c* (see FIG. 4). The toner discharging member 122 is driven to rotate by a toner discharging member driving motor 126 (see FIG. 9). A rotative direction of the screw auger is set such that the toner is carried toward the toner discharge opening 123 from each end in the axial direction of the toner discharging member 122.

A toner discharging member partition wall 124 is provided between the toner discharging member 122 and the toner stirring member 125. This allows the toner, which has been scooped up by the toner stirring member 125, to remain around the toner discharging member 122 by an appropriate amount of toner.

The toner stirring member 125 is rotated in a direction indicated by an arrow Z (see FIG. 3) so as to stir a toner and scoop up the toner toward the toner discharging member 122. The toner scooping members 125*b* are rotated so as to slide along an inside wall of the toner container 121 while being deformed due to their flexibility. This causes the toner to be carried toward the toner discharging member 122. Then, the toner discharging member 122 is rotated so that the toner, which has been carried to the toner discharging member 122, is directed toward the toner discharge opening 123.

The following description will discuss, with reference to drawings, the characteristic configuration of the image forming apparatus 100 in accordance with the present embodiment.

Figure 5:
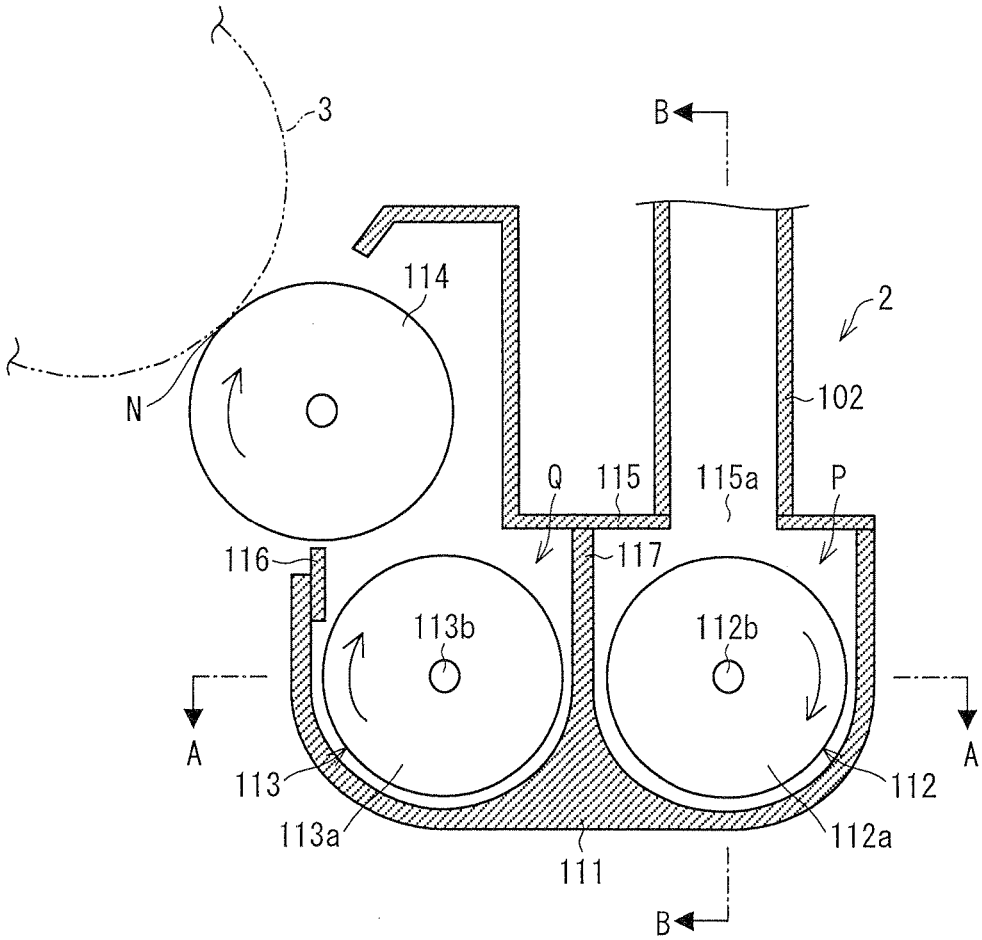
FIG. 5 is a cross sectional view illustrating a configuration of a developing device included in the image forming apparatus.
Figure 6:
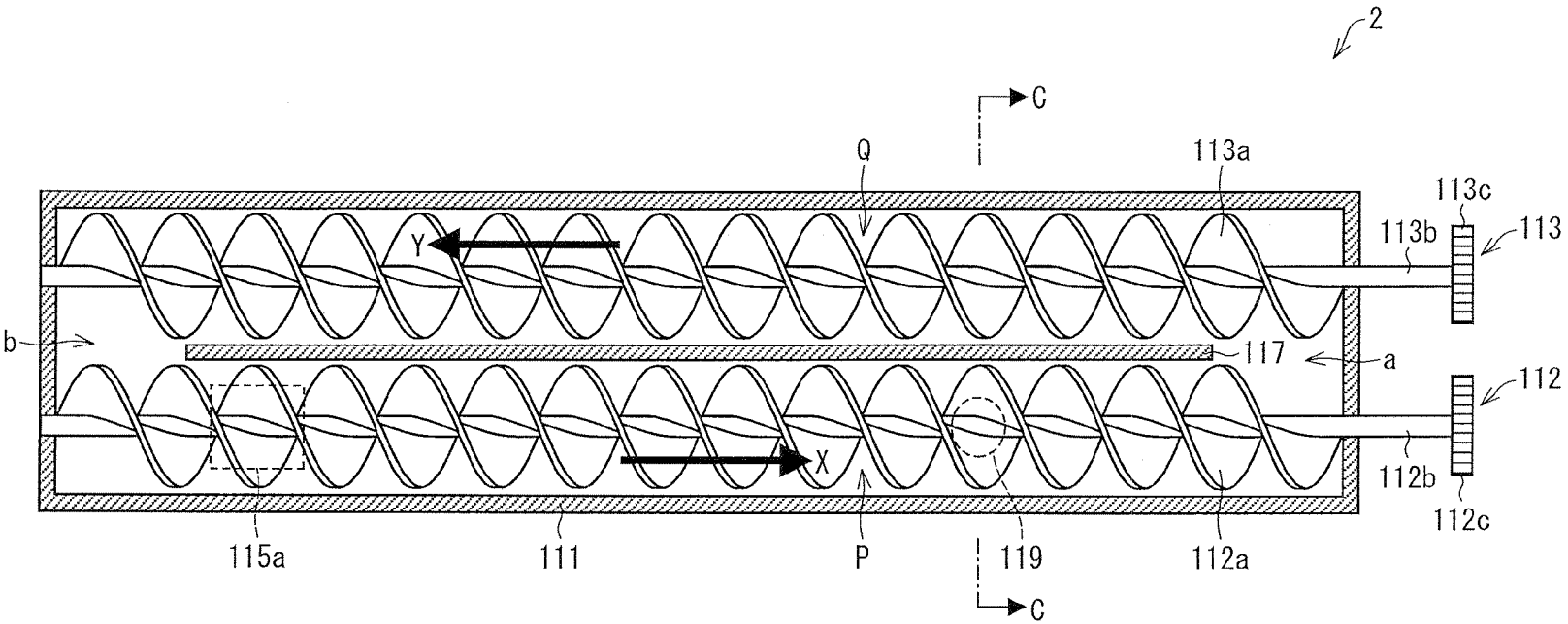
FIG. 6 is a cross sectional view taken along the line A-A of FIG. 5.
Figure 7:
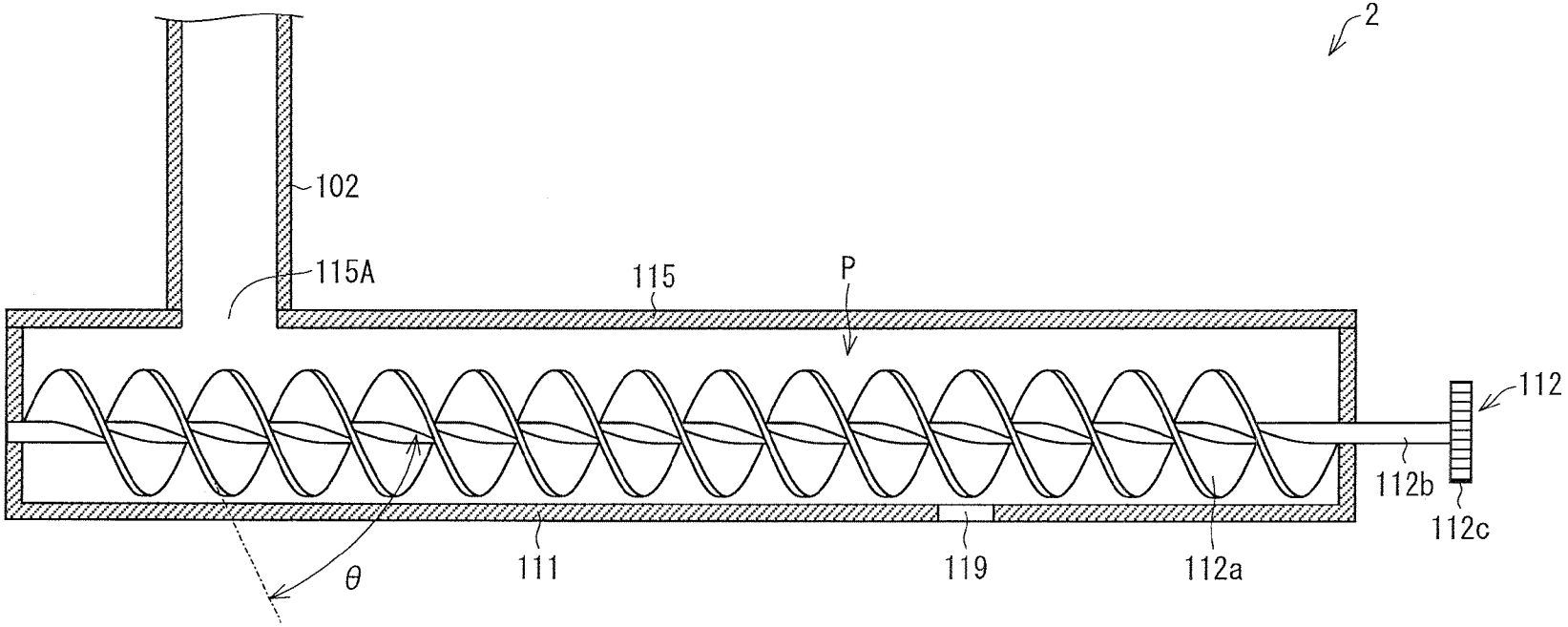
FIG. 7 is a cross sectional view taken along the line B-B of FIG. 5.
Figure 8:
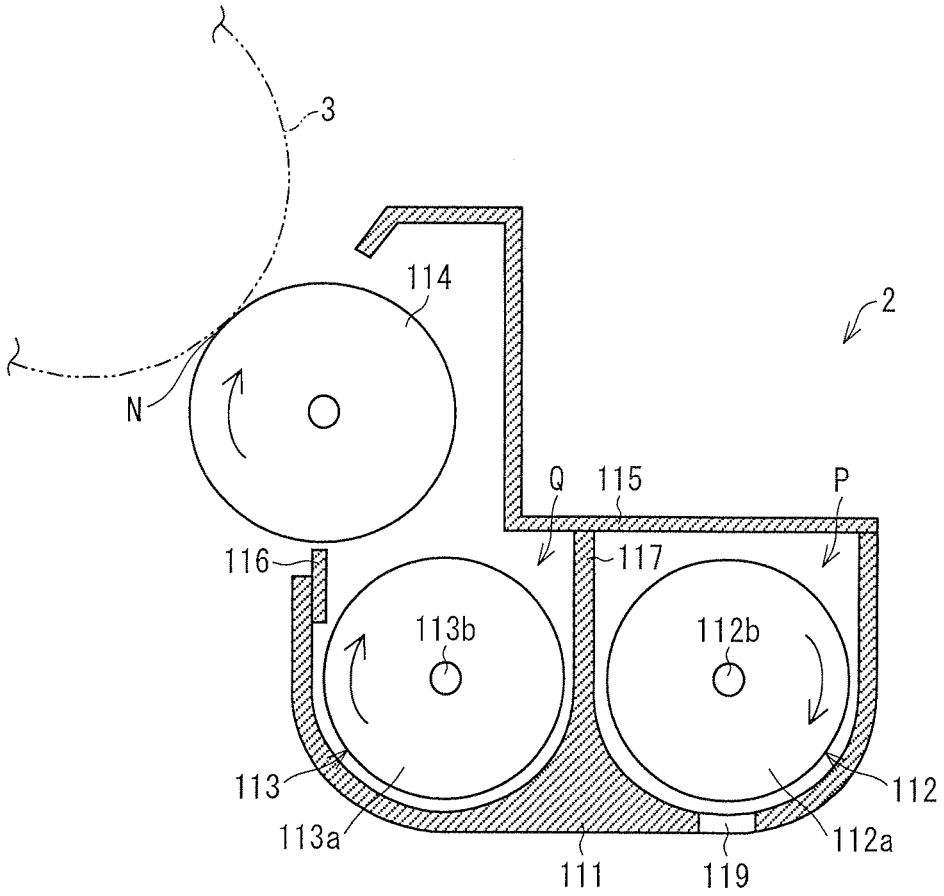
FIG. 8 is a cross sectional view taken along the line C-C of FIG. 6.

FIG. 5 is a cross sectional view illustrating a developing device included in the image forming apparatus of the present embodiment. FIG. 6 is a cross sectional view taken along the line A-A of FIG. 5. FIG. 7 is a cross sectional view taken along the line B-B of FIG. 5. FIG. 8 is a cross sectional view taken along the line C-C of FIG. 6.

The following description will discuss the developing device 2 of the present embodiment with reference to drawings.

The developing devices 2 include respective developing rollers (developer holding member) 114 which are provided in the respective developing tanks 111 so as to face the respective photoreceptor drums 3 (see FIG. 5). The developing roller 114 supplies toner onto the surface of the photoreceptor drum 3 so as to make visible an electrostatic latent image which has been formed on the surface of the photoreceptor drum 3 (i.e., the electrostatic latent image is developed).

Each of the developing devices 2 includes, in addition to the developing roller 114, the developing tank 111, a developing tank cover 115, a toner supply inlet 115*a*, a doctor blade 116, a first carrying member 112, a second carrying member 113, a partition plate (partition wall) 117, and a toner density detecting sensor 119.

The developing tank 111 is a tank which contains a two-component developer (hereinafter, simply referred to as "developer") containing toner and carrier. The developing roller 114, the first carrying member 112, the second carrying member 113, and the like are provided in the developing tank 111. Note that the carrier of the present embodiment is a magnetic carrier.

The developing tank cover 115 is removably provided above the developing tank 111 (see FIGS. 5 and 7). The developing tank cover 115 has the toner supply inlet 115*a* via which unused toner is supplied to the developing tank 111.

In the developing tank 111, the partition plate 117 is provided between the first carrying member 112 and the second carrying member 113. The partition plate 117 extends in a direction in parallel with axial directions (in which rotary shafts extend) of respective of the first carrying member 112 and the second carrying member 113. An internal part of the developing tank 111 is divided by the partition plate 117 into (i) a first carrying path P in which the first carrying member 112 is provided and (ii) a second carrying path Q in which the second carrying member 113 is provided.

The partition plate 117 is provided in the developing tank 111 so that its both ends are away, in the axial direction of the first (second) carrying member 112 (113), from respective facing inside surfaces of the developing tank 111. This allows formations of two communicating paths, via which the first carrying path P and the second carrying path Q communicate with each other around the both ends of the developing tank 111 in each axial direction of the first and second carrying members 112 and 113. Hereinafter, one of the two communicating paths formed around one of the both ends in a direction indicated by arrow X (in a direction X) of FIG. 6 is referred to as "first communicating path a" and the other of the two communicating paths formed around the other of the both ends in a direction indicated by arrow Y (in a direction Y) of FIG. 6 is referred to as "second communicating path b".

The toner supply inlet 115*a* is provided upstream of the direction X so as to be near the second communicating path b in the first carrying path P.

The first carrying member 112 and the second carrying member 113 are juxtaposed (i) so as to be adjacent to each other via the partition plate 117, (ii) such that their respective rotary shafts extend in parallel with each other, and (iii) such that they rotate in respective reverse directions (see FIGS. 6 and 8). Furthermore, the first carrying member 112 carries the developer in the direction X, whereas the second carrying member 113 carries the developer in the direction Y, which is reverse to the direction X (see FIG. 6).

The first carrying member 112 includes (i) a screw auger made up of a first spiral carrying blade 112*a* and a first rotary shaft 112*b* and (ii) a gear 112*c* (see FIG. 6). The second carrying member 113 includes (i) a screw auger made up of a second spiral carrying blade 113*a* and a second rotary shaft 113*b* and (ii) a gear 113*c* (see FIG. 6). Each of the first carrying member 112 and the second carrying member 113 is driven to rotate by driving means (not illustrated) such as a motor so as to stir and carry the developer.

The first carrying member 112 is configured such that an angle θ falls within a range between 30 degrees and 60 degrees, where the angle θ is an angle at which the first rotary shaft 112*b* is to outer edge parts of the first carrying blade 112*a*, i.e., an angle at which a spiral blade of the first carrying blade 112*a* is inclined, when the first rotary shaft 112*b* is viewed in a vertical direction (see FIG. 7).

In a case where the angle θ of the spiral blade of the first carrying member 112 is 30 degrees or more but 60 degrees or less, the developer is to be strongly stirred in a rotational direction of the first carrying member 112. It is therefore hard for a phenomenon called "floating toner" to occur in which phenomenon supplied toner is carried while floating above the developer. This allows the toner density detecting sensor 119 to detect the supplied toner with accuracy.

In contrast, in a case where the angle θ is less than 30 degrees, a speed, at which the developer is carried by the first carrying member 112, is decreased. This accelerates abrasion of the developer. In a case where the angle θ is more than 60 degrees, the speed, at which the developer is carried by the first carrying member 112, becomes too fast. This easily causes floating toner.

The developing roller 114 is a magnet roller which is driven to rotate, by driving means (not illustrated), about its shaft center. The developing roller 114 scoops up and holds the developer on its surface so that toner contained in the developer held on the surface is to be supplied to the photoreceptor drum 3.

The developer, which is carried by the developing roller 114, comes in contact with the photoreceptor drum 3 in a most proximate area. Such a proximate area is a developer nip area N. In the developer nip area N, a developing bias voltage is applied to the developing roller 114 from a power source (not illustrated), which is connected with the developing roller 114, so that the toner is supplied from the developer held on the surface of the developing roller 114 onto an electrostatic latent image formed on the surface of the photoreceptor drum 3.

The doctor blade (layer thickness controlling blade) 116 is provided in the vicinity of the surface of the developing roller 114.

The doctor blade 116 is a plate member which extends in parallel with an axial direction of the developing roller 114. The doctor blade 116 is provided vertically under the developing roller 114 such that (i) one lower end part of the doctor blade 116 is supported by the developing tank 111 and (ii) the other upper end part of the doctor blade 116 is away from the surface of the developing roller 114. The doctor blade 116 can be made of stainless steel. Alternatively, the doctor blade 116 can be made of a material such as aluminum or synthetic resin.

The toner density detecting sensor 119 is provided near the first communicating path a in the first carrying path P so as to be away from the toner supply inlet 115*a* and so as to be under the toner supply inlet 115*a* downstream of the developer carrying direction (i.e., downstream of the direction X) (see FIGS. 6 and 8). The toner density detecting sensor 119 is provided, vertically under the first carrying member 112, on a bottom surface of the developing tank 111. Specifically, the toner density detecting sensor 119 is provided on a bottom surface of the first carrying path P such that a sensing surface of the toner density detecting sensor 119 is exposed in the developing tank 111.

The toner density detecting sensor 119 constitutes a toner empty detecting section 200 (later described, see FIG. 1) and is electrically connected with a control device 32 (later described, see FIG. 9). The toner density detecting sensor 119 is realized by a magnetic permeability sensor.

The magnetic permeability sensor, by which the toner density detecting sensor 119 is realized, is connected with a power source (not illustrated). The power source applies, to the magnetic permeability sensor, (i) a driving voltage for driving the magnetic permeability sensor and (ii) a control voltage (TSG: toner sensor gain) for causing the magnetic permeability sensor to supply an output voltage, indicative of a detected toner density, to the control device 32 (see FIG. 9) as a sensor output. The control device 32 controls the power source to apply the voltages to the magnetic permeability sensor.

The magnetic permeability sensor is a sensor which outputs an output voltage (sensor output) as a detected toner density in response to an applied control voltage (TSG). Note that the magnetic permeability sensor basically achieves a good sensitivity when it outputs an output voltage around median of output voltages. As such, the control device 32 adjusts the control voltage (TSG) so that the magnetic permeability sensor supplies an output voltage around the median to the control device 32. The control device 32 carries out a gain adjustment in a process for correcting the control voltage, and such a gain adjustment is appropriately made in accordance with factors such as operating environment, life duration of developer, job frequency, and a printing ratio. Such a magnetic permeability sensor, which functions as above described, is commercially available. Examples of such a magnetic permeability sensor encompass TS-L, TS-A, and TS-K (each of those represents a product name, manufactured by TDK Corporation).

The following description will discuss how developer is carried in the developing tank 111 of the developing device 2.

The toner, which is contained in the toner supplying device 22, is transferred to the developing tank 111, via the toner transfer mechanism 102 and the toner supply inlet 115*a*. This causes the toner to be supplied to the developing tank 111 (see FIG. 5).

In the developing tank 111, the first carrying member 112 and the second carrying member 113 are driven to rotate by driving means (not illustrated) such as a motor so as to carry the developer. Specifically, the developer is carried through the first carrying path P by the first carrying member 112 in the direction X while being stirred, and then reaches the first communicating path a (see FIG. 6). The developer, which has reached the first communicating path a, is carried to the second carrying path Q, via the first communicating path a.

In the second carrying path Q, the developer is carried by the second carrying member 113 in the direction Y while being stirred, and then reaches the second communicating path b. The developer, which has reached the second communicating path b, is carried to the first carrying path P, via the second communicating path b.

That is, the first carrying member 112 and the second carrying member 113 carry the developer in respective reverse directions while stirring the developer.

As such, the developer is circularly moved, in the developing tank 111, through the first carrying path P, the first communicating path a, the second carrying path Q, and the second communicating path b, in this order. The developer, which is being carried through the second carrying path Q, is scooped up, while staying on the surface of the developing roller 114, by the developing roller 114 (see FIG. 5) in response to rotation of the developing roller 114. The toner of the developer, which has been scooped up by the developing roller 114, is moved to the photoreceptor drum 3, and then the toner is sequentially consumed.

In order to make up for consumed toner, unused toner is supplied to the first carrying path P via the toner supply inlet 115*a*. Supplied toner is stirred by the first carrying member 112 so as to be mixed with the developer which has existed in the first carrying path P.

The following descriptions will discuss (i) a toner density control section of the image forming apparatus 100 and (ii) how toner is supplied to the developing device 2.

The toner density control section maintains, at a constant level, a toner density in the developing tank 111. Specifically, the toner density control section controls the toner supplying device 22 to supply toner to the developing tank 111, in order to prevent a decrease in toner density in the developing tank 111, which decrease is caused when the toner in the developing tank 111 is consumed to form an image.

The toner density control section can maintain the toner density at a constant level with the use of general control such as a control by use of a toner density detecting sensor, a control which his carried out in accordance with a patch image density, or a control which is carried out in accordance with a dot count. Out of these, it is preferable to employ the control which is carried out in accordance with the dot counts. In the present embodiment, the image forming apparatus 100 carries out a control in accordance with the dot count.

The image forming apparatus 100 includes a dot-counting device (dot-counting section) 35 (see FIG. 9) for counting dot data, which varies depending on image data to be sent to the exposure unit 1. A toner density control section 300 controls, in accordance with dot data counted by the dot-counting device 35, the toner supplying device 22 to supply toner to the developing device 2. Note that FIG. 9 is a block diagram illustrating a control system configuration of the image forming apparatus 100 in accordance with the present embodiment.

Figure 9:
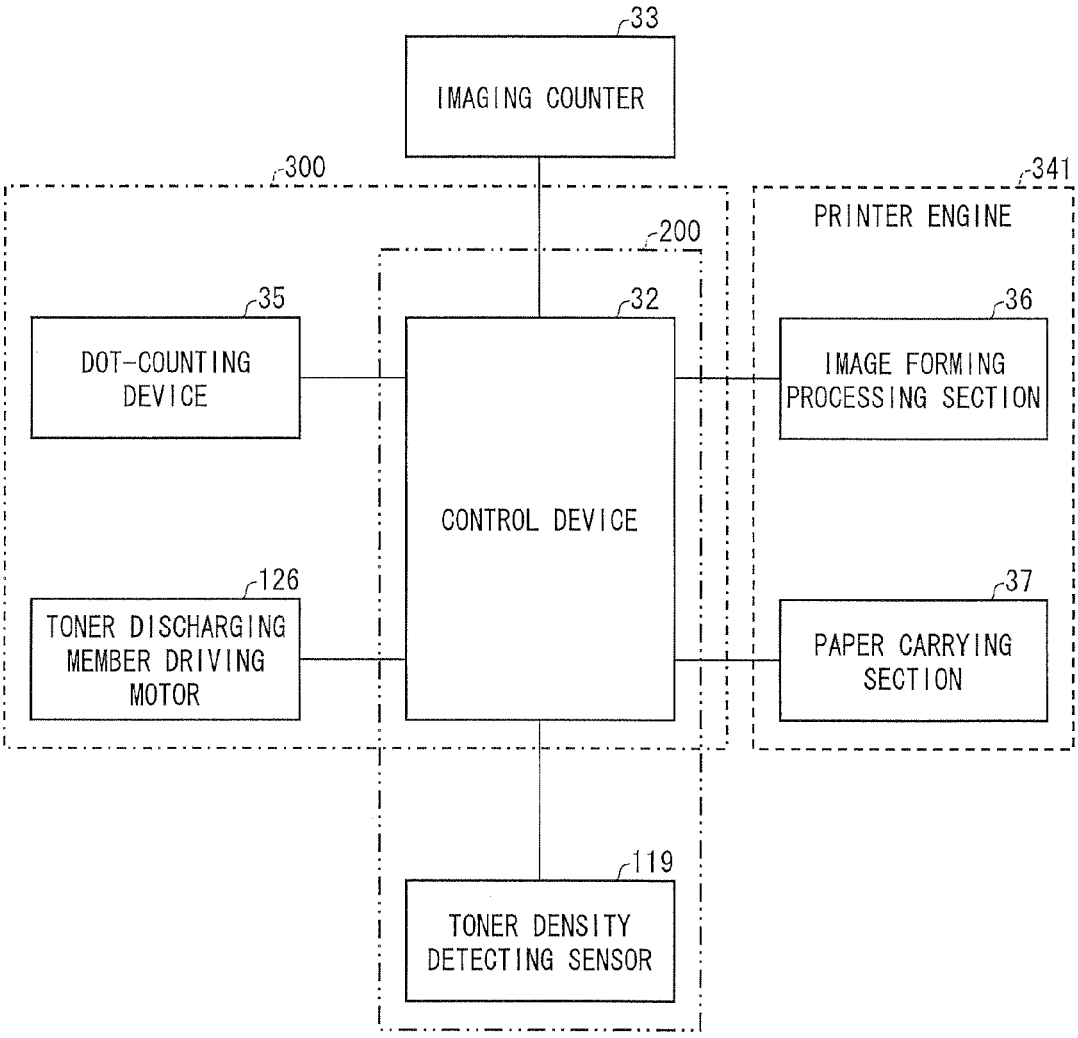
FIG. 9 is a block diagram illustrating a configuration of a control system in the image forming apparatus.

The image forming apparatus 100 includes (i) an imaging counter 33 which counts the cumulative number of image forming operations, (ii) the dot-counting device 35 which detects the integrated number of pixels of an image to be formed on the photoreceptor drum 3, (iii) the toner density detecting sensor 119 which detects a toner density of developer in the first carrying path P of the developing tank 111, (iv) a printer engine 341 including an image forming processing section 36 and a paper carrying section 37, (v) a toner discharging member driving motor 126 which drives the toner discharging member 122 which supplies toner to the developing tank 111, and (vi) the control device 32 which includes a CPU, a ROM, and a RAM (see FIG. 9). The control device 32 controls the above constituent members.

In the image forming apparatus 100, the toner density control section 300 is mainly made up of the dot-counting device 35, the control device 32, and the toner discharging member driving motor 126.

The dot-counting device 35 integrates the number of pixels of an image (electrostatic latent image) formed on the photoreceptor drum 3 in accordance with an image to be printed. Specifically, the dot-counting device 35 integrates the number of pixels of (i) an image to be printed and (ii) an image which has been printed so far. The integrated number of pixels (i.e., the counted number of dots) is supplied to and stored in the control device 32 as a dot count. Note that it is possible to estimate, based on the integrated number of pixels, an amount of toner to be consumed during forming of an image.

The control device 32 calculates, based on the dot count, the amount of toner to be consumed during forming of an image. The control device 32 then controls, in accordance with a calculated amount of toner, the toner discharging member driving motor 126 to rotate the toner discharging member 122 of the toner supplying device 22.

When toner in developer contained in the developing device 2 (developing tank 111) of the image forming apparatus 100 is consumed during forming of an image, the toner density control section 300 (i) estimates, based on a counted dot count detected by the dot-counting device 35, an amount of toner which has been consumed in the developing device 2, and then (ii) controls, in accordance with an estimated amount of consumed toner, the toner discharging member driving motor 126 to rotate so that toner is supplied by an amount which corresponds to the estimated amount of consumed toner.

The toner, whose amount corresponds to the amount of toner consumed in the developing device 2 (developing tank 111), is thus supplied from the toner supplying device 22 to the developing device 2 (developing tank 111).

A toner empty detecting section detects empty of toner in the toner supplying device 22. The toner empty detecting section determines, based on a toner density detected by the toner density detecting sensor 119, that no toner is supplied from the toner supplying device 22 to the developing device 2. That is, the toner empty detecting section determines that there remains no toner (toner empty) in the toner supplying device 22.

The image forming apparatus 100 includes a toner empty detecting section 200 which is mainly made up of the toner density detecting sensor 119 and the control device 32 (see FIG. 9).

In a case where the toner density detecting sensor is provided apart from the toner supply inlet as early described, it is not possible to directly detect whether or not toner has been supplied, by monitoring a change in sensor output occurred immediately after an instruction on supplying toner. In such a case, detection of toner empty will be delayed, and it is therefore not possible to solve the problem that carriers are more frequently adhered to a photoreceptor.

The following description will discusses the toner empty detecting section 200, which can detect toner empty without delay even in a configuration where the toner density detecting sensor is provided apart from the toner supply inlet, in the image forming apparatus 100 of the present embodiment. Namely, the toner empty detecting section 200 can detect toner empty without delay, by detecting, based on a toner density detected by the toner density detecting sensor 119, whether or not toner has been supplied, even in the configuration in which the toner density detecting sensor 119 is provided apart from the toner supply inlet 115*a*.

The toner density detecting sensor 119 monitors a toner density of the developer in the first carrying path P. In other words, the toner density detecting sensor 119 monitors magnetic permeability of the developer in the first carrying path P, like a conventional magnetic permeability sensor.

Figure 1:
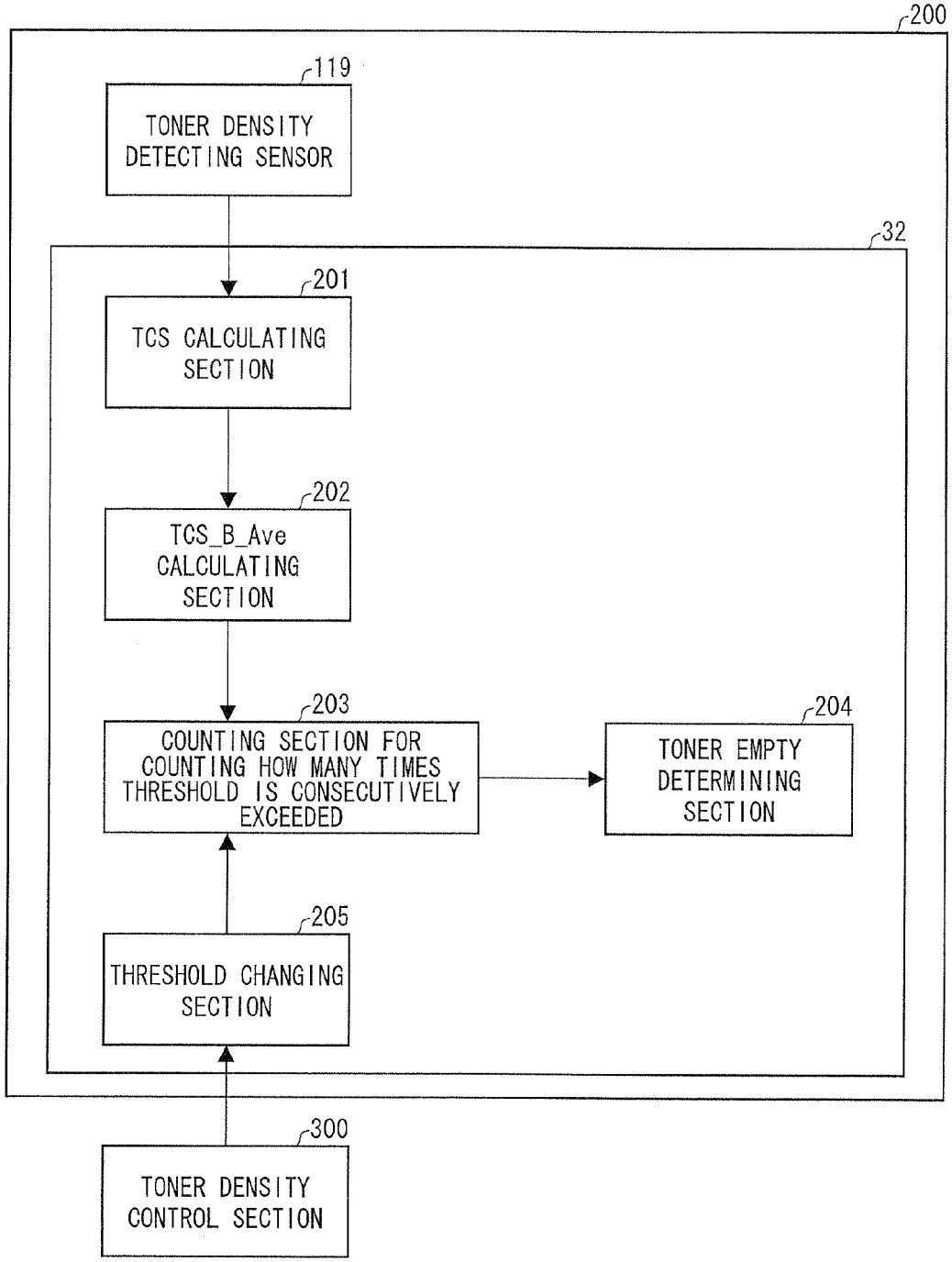
FIG. 1 is a block diagram illustrating a configuration of a toner empty detecting section included in an image forming apparatus, in accordance with an embodiment of the present invention.

A feature of the present embodiment resides in how the control device 32 determines toner empty. FIG. 1 is a block diagram illustrating, in detail, the toner empty detecting section 200.

The toner empty detecting section 200 includes the toner density detecting sensor 119, a TCS calculating section (one-rotation average calculating section) 201, a TCS_B_Ave calculating section (block average calculating section) 202, a counting section 203 for counting how many times a threshold is consecutively exceeded (measurement section for counting how many times the threshold is consecutively exceeded), a threshold changing section 205, and a toner empty determining section (toner shortage determining section) 204 (see FIG. 1). The TCS calculating section 201, the TCS_B_Ave calculating section 202, the counting section 203, the threshold changing section 205, and the toner empty determining section 204 are included in the control device 32 (monitoring/detecting section). The control device 32 monitors an output (sensor output) of the magnetic permeability sensor so as to detect toner shortage in the toner supplying device 22.

The TCS calculating section 201 calculates an average output (one-rotation average) by periodically sampling, N times, a sensor output (output voltage) of the toner density detecting sensor 119 during a time period equivalent to a time period required for one (1) rotation of the first carrying member 112 (first carrying blade 112*a*). Hereinafter, the one-rotation average is referred to as "TCS".

Figure 10:
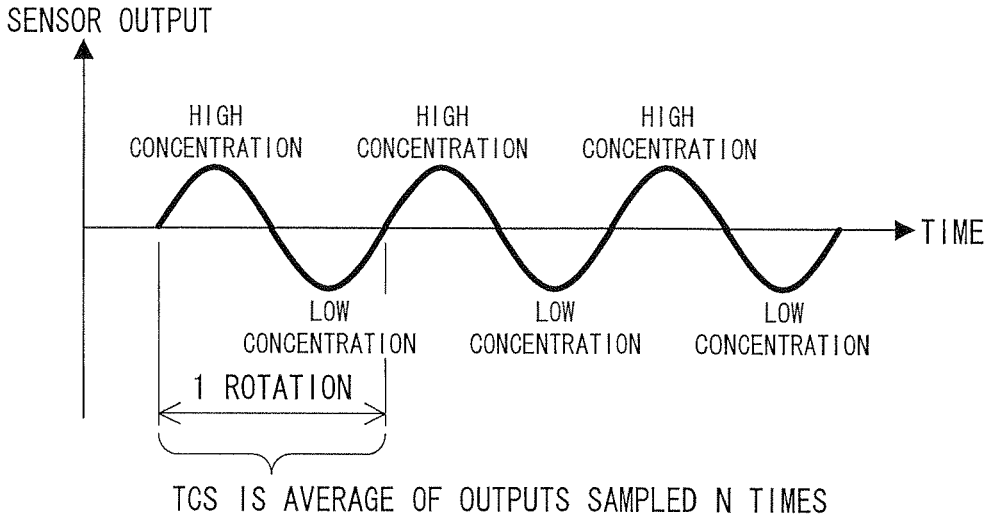
FIG. 10 is a view for explaining a TCS calculated by a TCS calculating section of the toner empty detecting section.

The rotation of the first carrying blade 112*a* causes a high concentration region and a low concentration region to alternate in the developer. The alternation causes the toner density detecting sensor 119 to have an output (sensor output) which changes in an S-curve in sync with a rotation cycle of the first carrying blade 112*a* (see FIG. 10). It is possible to eliminate an effect of such fluctuation in sensor output, by obtaining an average output by sampling the sensor output a plurality of times during a time period corresponding to one-rotation of the first carrying blade 112*a*.

Specifically, in the present embodiment, the TCS calculating section 201 calculates a TCS by sampling the sensor output 22 (N) times on a cycle of 10 msec during 220 msec (i.e., a time period corresponding to one-rotation of the first carrying blade 112*a*) which is a time period required for the first carrying member 112 (first carrying blade 112*a*) to make one rotation (note that N=220/10). A calculated TCS is supplied to the TCS_B_Ave calculating section 202 by which the TCS calculating section 201 is followed.

Note that the calculation of a TCS is not essential. It is possible that sensor outputs are sampled at a fixed timing, i.e., (i) at a timing of each occurrence of a low concentration region of the developer, (ii) at a timing of each occurrence of a high concentration region of the developer, or (iii) at a timing of each occurrence of a time point between any adjacent low and high concentration regions of the developer, which low and high concentration regions occur in response to each rotation of the first carrying blade 112*a*. This allows a reduction in fluctuation of the sensor output caused by a difference between the any adjacent low and high concentration regions. It is therefore possible to send, to the TCS_B_Ave calculating section 202, a sampled sensor output as it is (i.e., without averaging sampled sensor outputs).

The TCS_B_Ave calculating section 202 (i) samples, on a fixed cycle, sensor outputs of the toner density detecting sensor 119, (ii) evenly divides, into a plurality of blocks, a time period corresponding to one (1) circulation period which is required for the developer in the developing tank 111 to circulate once in the developing tank 111, and (iii) calculates a block average for each of the plurality of blocks, which block average is an average of sampled sensor outputs during one (1) block time period corresponding to one (1) block.

Here, since a TCS is used as a sensor output of the toner density detecting sensor 119, an average of TCSs during one (1) block time period is to be calculated as a block average. Hereinafter, such a block average (i.e., an average of TCSs during one (1) block time period) is referred to as "TCS_B_Ave".

In the case of dividing, into the plurality of blocks, the time period corresponding to one (1) circulation period, the TCS_B_Ave calculating section 202 (i) treats, as one (1) block, M TCSs supplied from the TCS calculating section 201 and (ii) calculates, as a TCS_B_Ave, an average of the M TCSs.

Figure 11:
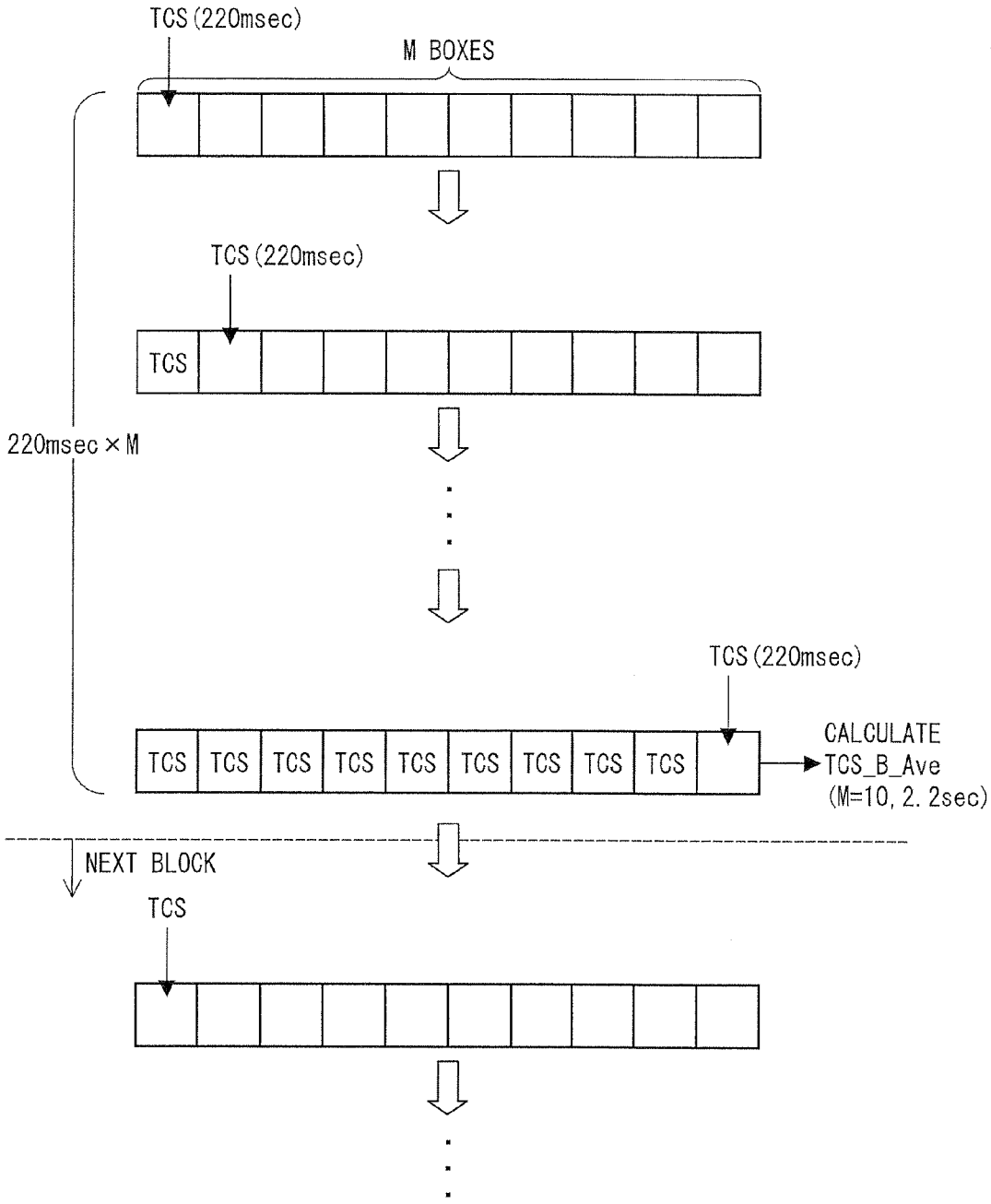
FIG. 11 is a view illustrating an outline of how a TCS_B_Ave is calculated by a TCS_B_Ave calculating section of the toner empty detecting section.

FIG. 11 illustrates an outline of how a TCS_B_Ave is calculated by the TCS_B_Ave calculating section 202. The TCS_B_Ave calculating section 202 has M boxes (sequence) which correspond to one (1) block. TCSs, which have been calculated by the TCS calculating section 201, are sequentially inputted into the respective boxes from the first box. In the present embodiment, since TCSs are calculated every 220 msec, the boxes are filled one by one for each 220 msec. It therefore takes M×220 msec for the M boxes to be filled. After the M boxes are filled, the TCSs in the respective M boxes are summed up, and then the sum of the TCSs is divided by M so as to obtain an average TCS (i.e., a TCS_B_Ave) of the one (1) block.

After the TCS_B_Ave is calculated, the M boxes are made empty. Subsequently, a TCS which is next calculated is inputted into the first box, and a similar process is then carried out so as to calculate a TCS_B_Ave for a following block.

According to the present embodiment, the TCS_B_Ave calculating section 202 calculates TCS_B_Aves for respective plurality of blocks (i) which are obtained by dividing 22 seconds (i.e., the time period corresponding to one (1) circulation of the developer) required for the developer to circulate once in the developing tank 111 and (ii) each of which corresponds to 10 TCSs (i.e., M=10). In this case, a size (time width) of one (1) block, which corresponds to 10 TCSs, becomes 2.2 seconds (i.e., 220 msec×10), and therefore TCS_B_Aves are calculated for each 2.2 seconds. Note that the time length (2.2 seconds) corresponds to a time period required for the first carrying member 112 (first carrying blade 112*a*) to be rotated 10 times.

Figure 12:
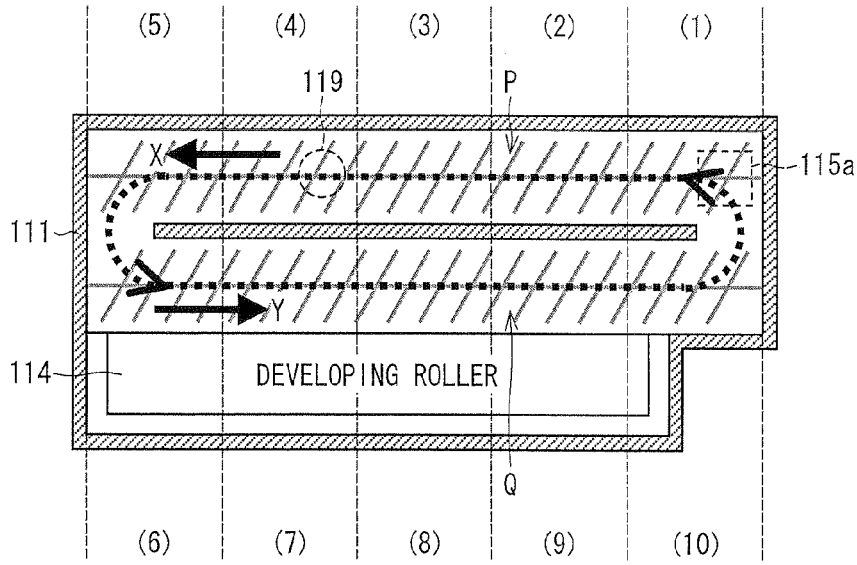
FIG. 12 is a view illustrating an outline of how the TCS_B_Ave calculating section of the toner empty detecting section divides, into a plurality of blocks, a time period corresponding to one (1) circulation period which is required for developer to be circulated once in a developing tank.

The block size of 2.2 seconds means that the 22 seconds (i.e., the time period corresponding to one (1) circulation) required for the developer to circulate once in the developing tank 111 is divided into blocks (i.e., 22 sec/2.2 sec). That is, the time period corresponding to one (1) circulation is divided into 10 blocks (1) through (10) (see FIG. 12).

With the configuration, as the number of TCSs constituting one (1) block, for which a TCS_B_Ave is calculated, is increased, a block size becomes larger and the number of blocks is decreased. On the contrary, as the number of TCSs constituting one (1) block is decreased, a block size becomes smaller and the number of blocks is increased. How to determine such a block size will be described later.

Calculated TCS_B_Aves are sequentially supplied to the counting section 203 by which the TCS_B_Ave calculating section 202 is followed.

The counting section 203 counts how many times TCS_B_Aves, which are sequentially supplied from the TCS_B_Ave calculating section 202, consecutively exceed a predetermined threshold. The counting section 203 includes a counter (not illustrated) which increases its counted value by one (1) count when a TCS_B_Ave exceeds the threshold.

The threshold is set to be higher, by not less than a predetermined voltage, than a reference sensor output which is set as a sensor output for a toner density (T/D 6%) which serves as a reference density (i.e., the threshold is set to correspond to a toner density lower than the toner density serving as the reference density). Hereinafter, the toner density serving as the reference density is referred to as "reference toner density".

A state where a TCS_B_Ave exceeds the threshold indicates a state where a sensor output of the toner density detecting sensor 119 is higher, by not less than the predetermined voltage, than the reference value (i.e., a state where a toner density is lower than the reference toner density).

How many times TCS_B_Aves consecutively exceed the threshold indicates the number of consecutive blocks each of which a sensor output is higher, by not less than the predetermined voltage, than the reference value. To put it another way, how many times TCS_B_Aves consecutively exceed the threshold corresponds to a time period during which the sensor output is continuously being higher, by not less than the predetermined voltage, than the reference value (i.e., a time period during which a toner density is continuously being lower than the reference toner density).

The toner empty detecting section 200 determines (detects) toner empty by (i) measuring a time period (i.e., the number of blocks) during which the toner density continues to be lower than the reference toner density by more than a tolerance level and (ii) predicting, based on the time period, that toner has run short in the toner supply device 22.

Figure 13:
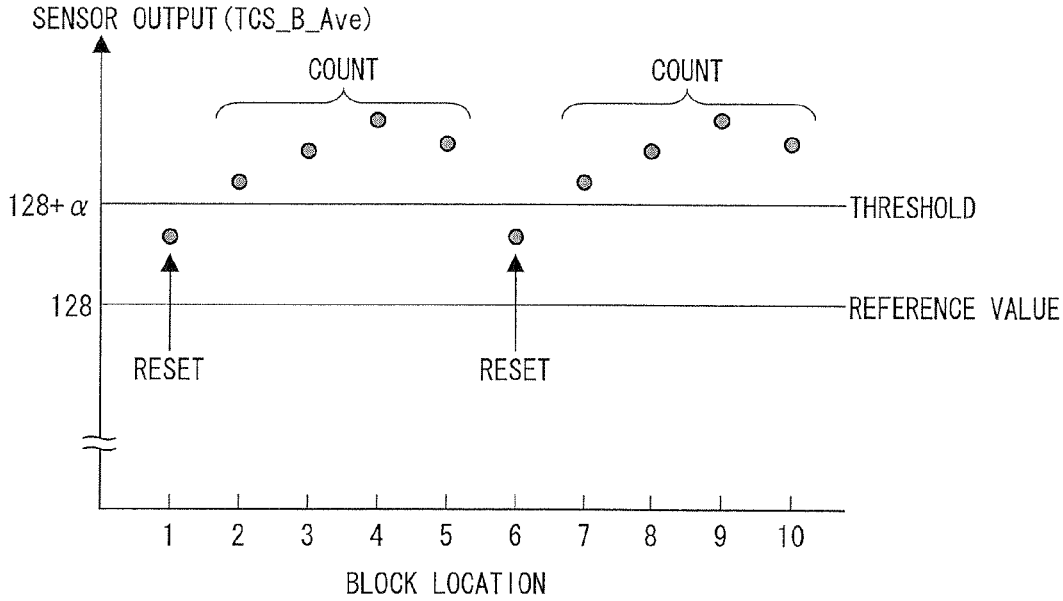
FIG. 13 is a view for explaining a state where, after a counter counts sensor outputs of a toner density detecting sensor of the image forming apparatus consecutively exceeding a threshold a plurality of times, the sensor output becomes lower than the threshold, and the counter is reset.

In the present embodiment, the reference value of the sensor output of the toner density detecting sensor 119 is set to "128" (see FIG. 13). As early described, the toner density detecting sensor 119 basically achieves a good sensitivity when it outputs an approximate median of its output voltages (sensor outputs). As such, in a case where a sensor output is expressed by 8-bit, the reference value is adjusted to correspond to "128" which is a median of the 8-bit.

Practically, the threshold is set to correspond to "the reference value+additional value α". The additional value α corresponds to the predetermined voltage (early described). The threshold is set to a value that a sensor output goes beyond after the sensor output wholly starts to rise as an amount of toner approaches a state of toner empty.

The counting section 203 resets the counted value to zero and then starts to count from the start, when the counting section 203 receives a TCS_B_Ave, which is lower than the threshold, while counting how many times the threshold is consecutively gone beyond. Note that, when toner has been supplied to the toner supply device 22, the counting section 203 receives a TCS_B_Ave, which is lower than the threshold, while counting how many times the threshold is consecutively gone beyond.

Even in a case where the counting section 203 starts to count how many times the threshold is consecutively gone beyond as an amount of toner approaches a state of toner empty, the counting section 203 thus resets the counted value to zero when toner is supplied to the toner supply device 22 and then starts to count from the start. This allows a problem to be avoided that toner empty is incorrectly detected (i.e., toner empty is detected too early) when an amount of remaining toner has become small.

Toner empty is to be detected during an image quality adjustment (process control) (later described in detail in Embodiment 2). In such a case, the counted number counted by the counting section 203 is to be reset when toner empty is not detected during the image quality adjustment.

The counting section 203 is more preferably configured such that a plurality of thresholds can be set and so as to count how many times the respective plurality of thresholds are gone beyond.

In the present embodiment, three additional values, i.e., "3" corresponding to a first additional value, "8" corresponding to a second additional value, and "16" corresponding to a third additional value are set as the "a" of the threshold "128+additional value α" (see FIG. 14). A counter w counts how many times a threshold of "128+3", corresponding to the first additional value of "3", is gone beyond. A counter x counts how many times a threshold "128+8", corresponding to the second additional value of "8", is gone beyond. A counter y counts how many times a threshold "128+16", corresponding to the third additional value of "16", is gone beyond. Note that FIG. 14 is an explanatory view illustrating a determination table based on which the toner empty determining section 204 determines toner empty (later described in detail).

In the case where the three thresholds are used, the counting section 203 causes the counters w, x, and y to increase their respective counted values by one (1) count or to be cleared (reset) based on a result of comparison between a supplied TCS_B_Ave and the respective three thresholds. Specifically, in a case where a supplied TCS_B_Ave is, for example, "146", all the three counters w, x, and y increase their respective counted values by one (1) count. In a case where a supplied TCS_B_Ave is, for example, "143", (i) the counters w and x increase their respective counted values by one (1) count and (ii) the counter y is reset. In a case where a supplied TCS_B_Ave is, for example, "130", all the three counters w, x, and y are reset.

In a case where a plurality of thresholds are used as above described, the toner empty determining section 204 determines that the toner has run short when any one of the counted values reaches a corresponding determination value (later described in detail).

The threshold changing section 205 changes, based on an amount of toner remaining in the toner supply device 22, a threshold to be used by the counting section 203. The threshold changing section 205 is configured to receive, from the toner density control section 300, information regarding an amount of toner which has been supplied to the developing tank 111 from the toner supply device 22. The threshold changing section 205 predicts, based on the information, an amount of toner remaining in the toner supply device 22.

When the amount of toner remaining in the toner supply device 22 becomes not more than a predetermined amount, the threshold changing section 205 changes a threshold, which is used by the counting section 203, so that the threshold approaches the reference value.

In the present embodiment, when the amount of remaining toner becomes 25% or less, the threshold changing section 205 changes the first through third additional values α, based on which the respective thresholds are determined, into "1", "5", and "8", respectively (see FIG. 14). This allows the counters w, x, and y of the counting section 203 to reliably increase their respective counted values by one (1) count, even in a case where a degree, to which the reference value is exceeded, is small.

When the amount of remaining toner becomes small, there occurs a problem that the toner density control section 300 cannot stably control the toner density. According to the present embodiment, the thresholds are changed in accordance with the amount of remaining toner in order to address such a problem.

Specifically, in a case where the amount of remaining toner is more than 25%, toner can be accurately supplied by an amount corresponding to a rotation of the toner discharging member driving motor 126 (see FIG. 9) which is controlled by the toner density control section 300. On the other hand, when the amount of remaining toner becomes 25% or less, there sometimes occurs a problem that toner is not supplied or toner is supplied insufficiently, even if the toner density control section 300 controls the toner discharging member driving motor 126 to rotate.

In order to address such a problem, when the amount of remaining toner reaches an amount at which the toner density control becomes unstable, the threshold changing section 205 changes the thresholds so that the thresholds approach the reference value. This allows toner empty to be reliably detected. As such, it is possible to avoid a problem of delay in detection of toner empty.

Note that the threshold changing section 205 is not an essential member but is merely a preferable member, as with the TCS calculating section 201.

The toner empty determining section 204 determines whether or not toner empty occurs based on the counted value of the counting section 203. The toner empty determining section 204 determines whether toner empty occurs with the use of, for example, a determination table as illustrated in FIG. 14.

The determination table of the present embodiment contains the following information: (i) additional values which are set according to amounts of remaining toner, (ii) the counters which are assigned in accordance with the respective additional values, and (iii) determination values which are set in accordance with the respective additional values (see FIG. 14).

In a case where the amount of remaining toner is more than 25%, the toner empty determining section 204 determines that toner empty has occurred when a counted value of the counter w for the first additional value corresponding to "3" reaches "50". Similarly, the toner empty determining section 204 determines that the toner empty has occurred (i) when a counted value of the counter x for the second additional value "8" reaches "30" or (ii) when a counted value of the counter y for the third additional value "16" reaches "10".

In a case where the amount of remaining toner is 25% or lower, the toner empty determining section 204 determines that toner empty has occurred when a counted value of the counter w for the first additional value corresponding to "1" reaches "50". Similarly, the toner empty determining section 204 determines that toner empty has occurred (i) when a counted value of the counter x for the second additional value corresponding to "5" reaches "30" or (ii) when a counted value of the counter y for the third additional value corresponding to "8" reaches "10".

As is clear from FIG. 14, the determination values are set to be smaller as the additional values (i.e., thresholds) become higher. Even when TCS_B_Aves exceed or continue to exceed the reference value for a relatively long period, the toner empty determining section 204 does not determine that the toner empty has occurred, provided that a difference between the TCS_B_Aves and the reference value is small. In the case where the difference between the TCS_B_Ave and the reference value is small, (i) it may not be a state where toner should be immediately supplied in response to an instruction from the toner density control section 300 or (ii) toner may be supplied by merely a small amount which is not sufficient to obtain a TCS_B_Ave of not more than the threshold(s). In view of the circumstances, a large determination value (i.e., the number of blocks), which corresponds to a time period required for the developer to circulate in the developing tank 111*a* plurality of times, is set in the case where the TCS_B_Aves exceeds the reference value and the difference between the TCS_B_Aves and the reference value is small.

On the contrary, in a case where TCS_B_Aves continue to exceed the reference value and a difference between the TCS_B_Aves and the reference value is large, the toner empty determining section 204 determines, even in a relatively short period, that toner empty has occurred. In the case where the TCS_B_Aves continue to exceed the reference value and a difference between the TCS_B_Aves and the reference value is large, it is a state where toner should be immediately supplied by a large amount, based on an instruction from the toner density control section 300, so that TCS_B_Aves become sufficiently below the thresholds. If the counters are not reset, in spite of such a state, after the developer circulates once in the developing tank 111, then it is possible to determine that toner empty has occurred. In view of the circumstances, a smallest determination value is set to a minimum value which corresponds to a time period required for the developer to circulate once in the developing tank 111, in a case where the TCS_B_Aves exceeds the reference value and a difference between the TCS_B_Aves and the reference value is the largest.

Toner empty needs to be determined after a confirmation that no toner is supplied (i.e., the counters are not reset) at least after a time period required for the developer to circulate once in the developing tank 111 elapsed. This is the reason why the smallest determination value is set to correspond to the time period required for the developer to circulate once in the developing tank 111.

The determination value is set to be smaller in the case where the amount of remaining toner is insufficient than in the case where the sufficient amount of toner remains, even though the additional values are identical to each other, for example "8" (see FIG. 14). This allows toner empty to be reliably detected, as early described. It is therefore possible to avoid a problem of delay in detection of toner empty.

According to the present embodiment, in a case where a sufficient amount of toner remains, it is determined that toner empty has occurred in a case where TCS_B_Aves continue to exceed, by "8," the reference value "128" for 66 seconds (i.e., 2.2 seconds×30). Whereas, in a case where an amount of remaining toner is insufficient, it is determined that toner empty has occurred in a case where TCS_B_Aves continue to exceed, by "8," the reference value "128" for merely 22 seconds (i.e., 2.2 seconds×10).

The following description will discuss how to set a size (time width) of a block for which the TCS_B_Ave calculating section 202 calculates a TCS_B_Ave.

As early described, a size of each block, for which a TCS_B_Ave is calculated, is determined based on the number "M" of TCSs which are used to calculate a TCS_B_Ave. When the M is large, a size of each of blocks is large. This causes a decrease in the number of blocks which is obtained by dividing a time period corresponding to one (1) circulation period required for the developer to be circulated once in the developing tank 111. On the contrary, when the M is small, a size of each of blocks is small. This causes an increase in the number of blocks.

Figure 15:
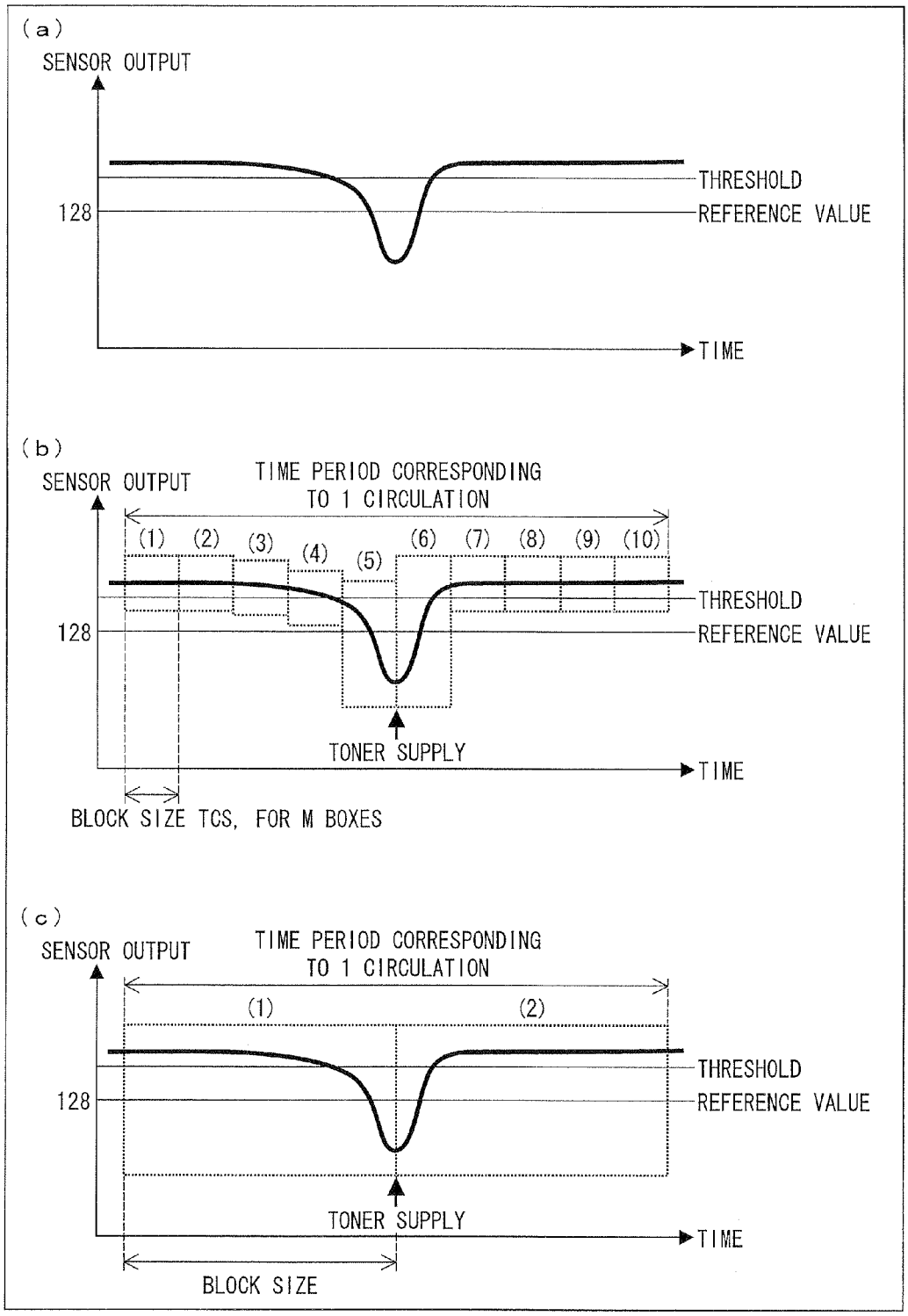
FIG. 15 Each of (a) through (c) of FIG. 15 is a view for explaining a block size used by the TCS_B_Ave calculating section of the toner empty detecting section to calculate a TCS_B_Ave.

(a) of FIG. 15 illustrates a sensor output of the toner density detecting sensor 119, which sensor output is obtained when toner is supplied for a minimum unit of time (e.g., for one (1) second) while the developer is circulating once in the developing tank 111. In (a) of FIG. 15, a horizontal axis indicates time. When toner is supplied, the sensor output is largely decreased as indicated by a valley shown in (a) of FIG. 15. As the time period for supplying toner becomes longer, a time width in which the sensor output is decreased becomes longer (i.e., the valley becomes wider) and a degree to which the sensor output is decreased becomes larger (i.e., the valley becomes deeper).

It is necessary that the size of each of the blocks is set such that a TCS_B_Ave, which is an average of sensor outputs in the blocks in each of which a sensor output is partially decreased in response to toner supply, becomes not higher than the threshold used by the counting section 203, which allows a counter, that is counting how many times the threshold is consecutively exceeded, to be reset.

In this case, the size of each of the blocks is more preferably set such that there are a plurality of blocks in each of which a sensor output is partially decreased in response to toner supply. In this case, it is possible to eliminate noise, which cannot be removed in a case of using a TCS_B_Ave calculated for each block, by resetting the counter, which has counted how many times the threshold is consecutively exceeded, in a case where the TCS_B_Aves become, consecutively twice, lower than the threshold.

(b) of FIG. 15 illustrates an example of a block sequence, in accordance with the present embodiment, in which "M" is set to "10" and a time period corresponding to one (1) circulation period which is required for the developer in the developing tank 111 to circulate once in the developing tank 111 is divided into 10 blocks (1) through (10). According to the example illustrated in (b) of FIG. 15, since TCS_B_Aves in the respective blocks (5) and (6) are lower than the threshold, the counter can be reset.

(c) of FIG. 15 illustrates a comparative example of a block sequence in which "M" is set to "50" and a time period corresponding to one (1) circulation period is divided into 2 blocks (1) and (2). According to the comparative example illustrated in (c) of FIG. 15, TCS_B_Aves in the block (1) and TCS_B_Aves in the block (2) are both higher than the threshold, because the size of each of the blocks (1) and (2) is too long. It is therefore not possible to reset the counter, which is counting how many times the threshold is consecutively exceeded.

The valley shape of the sensor output, which appears in response to toner supply, becomes wider and shallower, as (i) the time period for toner supply becomes longer and (ii) the toner supply inlet 115*a* is farther from the toner density detecting sensor 119. This is because the above (i) and (ii) cause supplied toner to be mixed with the developer better.

Although it depends on a speed at which the developer in the developing tank 111 is carried, in a case where such a carrying speed is high, toner tends to fall while being dispersed. This allows the toner to be mixed with the developer immediately under the toner supply inlet 115*a*, and the toner is further mixed with the developer because the first carrying member 112 is rotated at a high speed. Consequently, the valley of the sensor output has wider and shallower shape. On the contrary, in a case where the carrying speed is low, the toner falls without being dispersed, and the toner is not further mixed with the developer because the first carrying member 112 is rotated at a low speed. Consequently, the valley of sensor output has narrower and deeper shape.

The shape of the valley of sensor output, which valley appears in response to toner supply, differs depending on fluidity of the developer and on fluidity of supplied toner.

The size the block and the threshold should be set, by taking into consideration a parameter which affects the shape of the valley, such that the toner supply can be surely detected (i.e., the counter can be reset), even in a case where (i) toner is supplied for the minimum unit of time (e.g., for one (1) second) and (ii) the shape of the valley becomes wider and shallower because supplied toner is mixed with the developer before the supplied toner reaches the toner density detecting sensor 119.

In the early description, the counting section 203 of the toner empty detecting section 200 resets the counted value to zero when a TCS_B_Ave is lower than the threshold. Alternatively, the counter can be reset when the TCS_B_Ave becomes not higher than the reference value.

With the configuration, toner empty can be detected earlier than the configuration in which the counter is reset based on the threshold, even in a case where remaining amounts of toner are identical to each other in the toner supply device 22. That is, a delay in detecting toner empty can certainly be avoided, even though toner empty may be detected in a state where a certain amount of toner remains in the toner supply device 22.

According to the image forming apparatus 100 of the present embodiment, as early described, the TCS_B_Ave calculating section 202 (i) periodically samples a sensor output of the toner density detecting sensor 119, (ii) evenly divides, into a plurality of blocks, a time period corresponding to one (1) circulation period which is required for the developer to be circulated once in the circulation carrying path, and (iii) calculates, for each of the plurality of blocks, a TCS_B_Ave which is an average of the sensor outputs in one (1) block time period corresponding to each of the plurality of blocks. The counting section 203 counts how many times calculated TCS_B_Aves consecutively exceed the threshold which is defined by an addition of a certain value and the reference value of the sensor output of the toner density detecting sensor 119. Then, the toner empty determining section 204 determines that toner has run short, when a counted value counted by the counter in the counting section 203 reaches the determination value, which is set in advance and is not less than the number of blocks corresponding to one (1) circulation period.

The state where the TCS_B_Aves for the respective plurality of blocks consecutively exceed the threshold indicates a state where toner supply is not detected although toner needs to be supplied. In such a state, toner is most likely to have run short. The fact that the threshold is not consecutively exceeded under the circumstances means that a TCS_B_Ave became not higher than the threshold. This is because low magnetic permeability of the developer which is located in a region where supplied toner was unevenly distributed, was detected. It is therefore possible to determine that toner to be supplied remains in the toner supply device 22 (i.e., toner has not run short).

In view of the circumstances, toner empty is detected, in a case where the number of times that the TCS_B_Aves for the respective plurality of blocks exceed the threshold becomes not less than the number of blocks corresponding to at least one (1) circulation period. That is, the toner empty determining section 204 determines that the toner to be supplied has run short, i.e., toner empty is detected, in a case where toner needs to be immediately supplied but a toner supply is not detected while the developer circulates once in the circulation carrying path.

According to the detection of toner empty, it is possible to detect toner shortage without delay by appropriately setting a time width of each of the plurality of blocks, the threshold, and the determination value, regardless of a positional relation between the toner supply inlet 115*a* and the toner density detecting sensor 119.

The image forming apparatus 100 of the present embodiment can therefore bring about an effect of suppressing adhesion of carrier to the photoreceptor drum 3 which is caused by a decrease in toner density.

Embodiment 2

The following describes an embodiment of the present invention with reference to drawings. For convenience, the same reference numerals are given to members which have functions identical with those employed in Embodiment 1.

Figure 16:
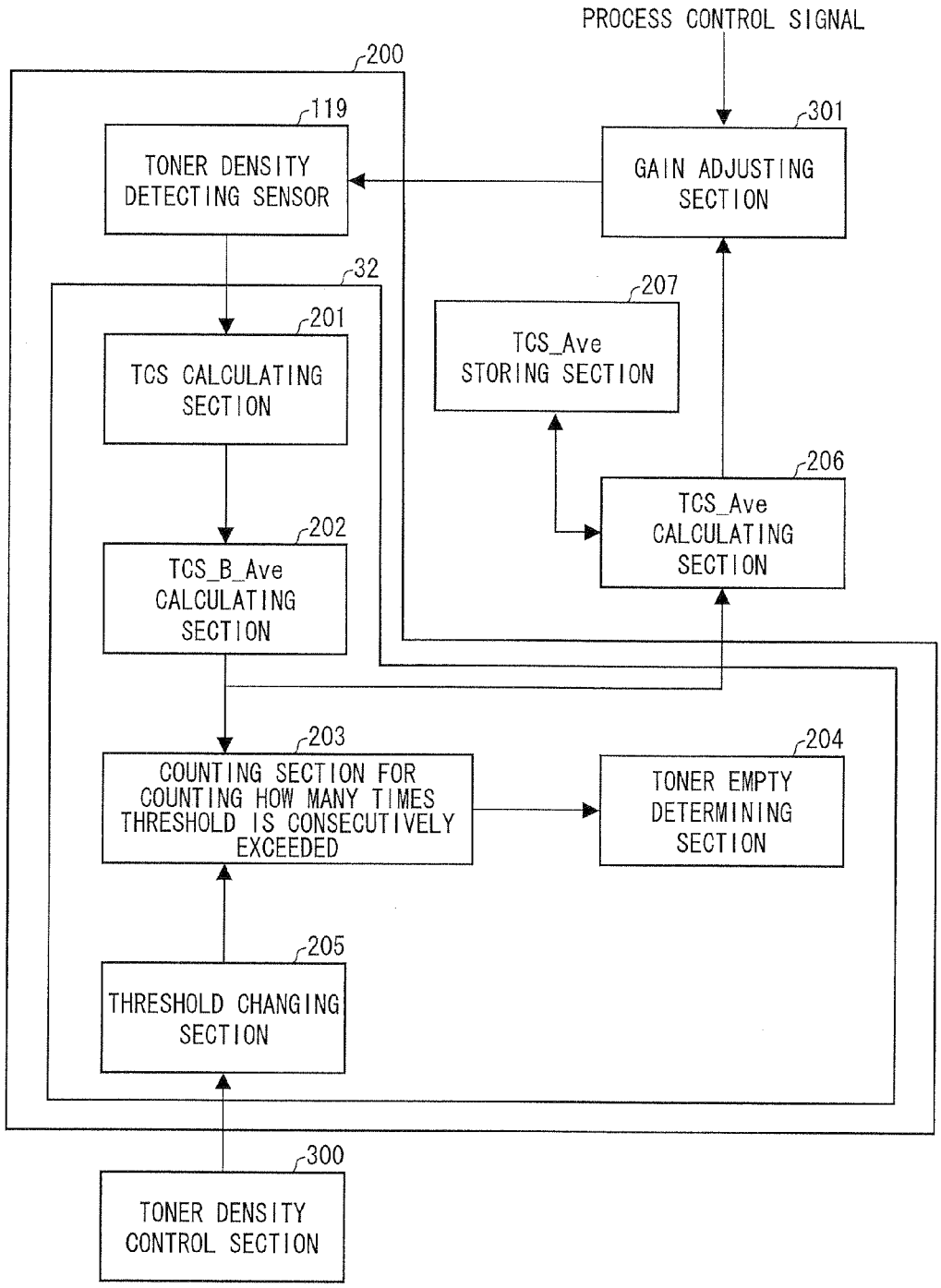
FIG. 16 is a block diagram illustrating a configuration of a toner empty detecting section, a gain adjusting section which adjusts a control voltage applied to the toner density detecting sensor, and the peripheries in an image forming apparatus, in accordance with another embodiment of the present invention.

An image forming apparatus in accordance with Embodiment 2 of the present invention has a configuration basically identical with that of the image forming apparatus 100 of Embodiment 1, except that (i) the image forming apparatus of Embodiment 2 further includes a TCS_Ave calculating section (moving average calculating section) 206, a TCS_Ave storing section (moving average storing section) 207, and a gain adjusting section 301 and (ii) the gain adjusting section 301 (a) adjusts a control voltage, which is applied to the toner density detecting sensor 119, so as to adjust a sensor output of the toner density detecting sensor 119 (see FIG. 16) and (b) carries out, in an image quality adjustment (hereinafter, abbreviated to process control), a gain adjustment based on a moving average of TCSs (sensor output) which moving average has been calculated by the TCS_Ave calculating section 206.

The gain adjusting section 301 is included in the control device 32 (see FIG. 9) of the image forming apparatus of Embodiment 2. Note that such a gain adjusting section 301 is also included in the image forming apparatus 100 of Embodiment 1, and a process control is of course carried out by the image forming apparatus 100 of Embodiment 1.

Conventionally, toner empty has been determined (detected) based on (i) a patch density detected in a process control and (ii) a sensor output of the toner density detecting sensor 119.

In the process control, toner patches are formed on an intermediate transfer belt 7 (see FIG. 2) or the like, and toner empty is determined based on a density of the toner patches. This allows toner empty to be detected more accurately, as compared with the detection based on a sensor output of the toner density detecting sensor 119.

Note, however, that the process control needs to be carried out after an active job is stopped, and therefore the process control is carried out only once for approximately several hundred sheets. Toner empty is therefore detected, in between respective tone process controls, based on a sensor output of the toner density detecting sensor 119.

In the process control, the gain adjusting section 301 adjusts a sensor output of the toner density detecting sensor 119. As early described, an output voltage of the magnetic permeability sensor, by which the toner density detecting sensor 119 is realized, achieves a good sensitivity when it outputs an output voltage around median of output voltages. In view of the circumstances, the gain adjusting section 301 samples sensor outputs of the toner density detecting sensor 119 during the process control. In a case where the sensor output is deviated from a median "128" expressed by 8-bit (e.g., "126"), the gain adjusting section 301 adjusts a control voltage (TSG), which is applied to the toner density detecting sensor 119, so that the sensor output becomes "128". Such an adjustment of the sensor output is referred to as "gain adjustment".

The gain adjusting section 301 receives a process control signal which is indicative of timing at which a process control is carried out. The gain adjusting section 301 makes a gain adjustment in response to the process control signal.

Figure 17:
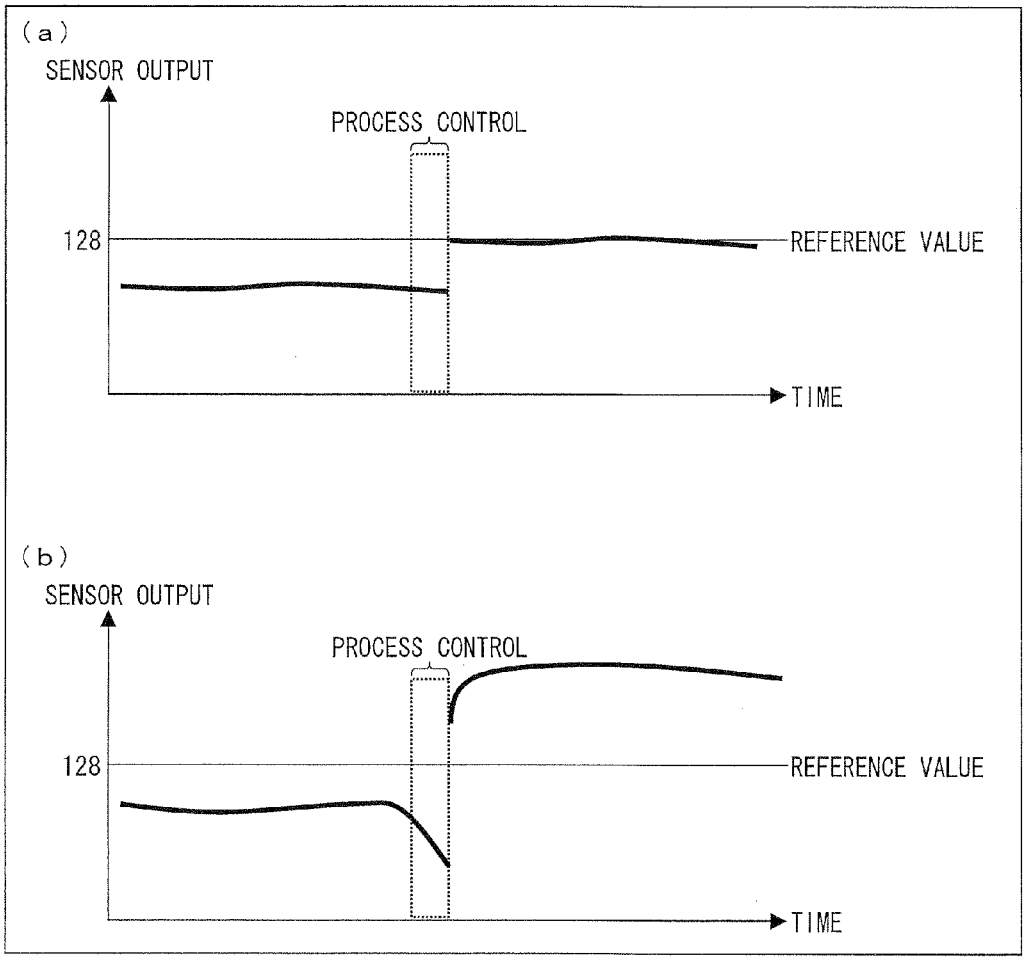
FIG. 17 Each of (a) and (b) of FIG. 17 is a view illustrating results of adjustment made by a conventional gain adjustment method in a process control.

In a case where a toner density of the developer in the developing tank 111 is uniform, it is possible to adjust a control voltage so that a sampled sensor output, obtained by sampling sensor outputs of the toner density detecting sensor 119, becomes a reference value (in this case, "128") of the sensor output (see (a) of FIG. 17).

However, a sampled sensor output becomes remarkably low (i.e., a toner density becomes remarkably high), in a case where (i) the toner density of the developer in the developing tank 111 becomes nonuniform in response to toner supply made immediately before a process control (see (b) of FIG. 17) and (ii) (a) a timing at which a sensor output of the toner density detecting sensor 119 is sampled and (b) a timing at which part of the developer, in which part supplied toner is unevenly distributed, passes through the toner density detecting sensor 119 overlap each other. In this case, if a control voltage is adjusted so that such an unusual sensor output becomes equal to the reference value ("128"), then a sensor output, which is obtained by detecting a usual toner density of the developer, is detected to become deviated from and considerably higher than the reference value, instead of becoming equal to the reference value.

Such a problem can be addressed by adjusting the control voltage based on a sensor output of the toner density detecting sensor 119 after the supplied toner is sufficiently mixed with the developer so that nonuniform toner density in the developing tank 111 can be corrected.

Note, however, that it takes 22 seconds for the developer of the present embodiment to be circulated once in the developing tank 111, as early described. Such a time period of 22 seconds is much longer than a time period (which is approximately 4 seconds) required for a process control. This causes another problem that a time period becomes long during which an image forming apparatus does not operate in the process control.

Figure 18:
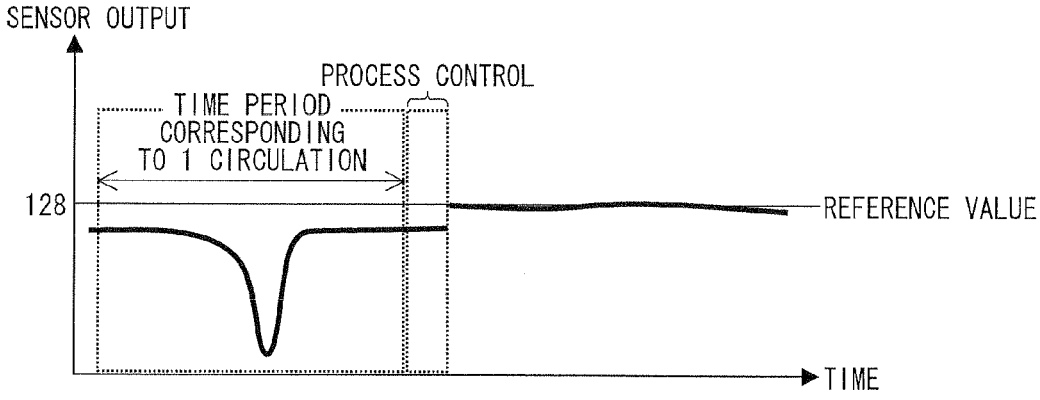
FIG. 18 is a view illustrating a result of gain adjustment made in a process control by a gain adjusting section included in the image forming apparatus of the another embodiment.

In order to address such a problem, the image forming apparatus of the present embodiment calculates, during processing a job and prior to a process control, a moving average of sensor outputs of the toner density detecting sensor 119 for a time period corresponding to one (1) circulation period, which is required for the developer to be circulated once in the developing tank 111 (see FIG. 18). In the process control, no sensor output of the toner density detecting sensor 119 is sampled and a control voltage is adjusted so that a calculated moving average for the time period corresponding to one (1) circulation period becomes equal to the reference value.

Even in a case where the toner density of the developer is nonuniform due to the fact that the toner was supplied before the process control (see FIG. 18), a gain adjustment can be accurately made. This is because the average of sensor outputs for the time period corresponding to one (1) circulation period allows the gain adjustment not to be adversely affected by the nonuniform toner density caused by supplied toner.

In the method of the present embodiment in which toner empty is detected based on a sensor output of the toner density detecting sensor 119, as early described, (i) the sensor outputs of the toner density detecting sensor 119 are sampled at predetermined time intervals so as to calculate TCSs and (ii) TCS_B_Aves are calculated based on calculated TCSs. Note that the TCSs and TCSB_Aves are constantly calculated while driving means (not illustrated) such as a motor is driving the first carrying member 112 and the second carrying member 113 of the developing device 2. It is therefore easy to obtain, by using the TCSs and the TCS_B_Aves which have been calculated for detecting toner empty, a moving average of sensor outputs for a time period required for the developer to be circulated once in the developing tank 111.

The following description will discuss, in more detail, a configuration which enables such a gain adjustment. The image forming apparatus of the present embodiment includes the TCS_Ave calculating section 206 and the TCS_Ave storing section 207, in addition to the toner empty detecting section 200 (see FIG. 16). The toner empty detecting section 200, the TCS_Ave calculating section 206, and the TCS_Ave storing section 207 constitute a monitoring/detecting section.

The TCS_Ave calculating section 206 calculates a moving average of sensor outputs of the toner density detecting sensor 119 for a time period corresponding to one (1) circulation period, which is required for the developer to be circulated once in the developing tank 111. Here, the moving average of sensor outputs is calculated for each time period corresponding to one (1) circulation period. However, the present embodiment is not limited to this, provided that the moving average of sensor outputs is calculated for a time period which is not shorter than the time period corresponding to one (1) circulation period.

The TCS calculating section 201 is included in the toner empty detecting section 200 and calculates TCSs as a sensor output. The TCS_Ave calculating section 206 calculates a TCS_Ave, which is a moving average of TCSs, with the use of calculated TCSs.

Specifically, the TCS_Ave calculating section 206 receives TCS_B_Aves calculated by the TCS_B_Ave calculating section 202, and calculates a TCS_Ave based on the TCS_B_Aves.

The TCS_Ave calculating section 206 constantly holds TCS_B_Aves for the time period corresponding to one (1) circulation period while a power source of the image forming apparatus is turned on, and deletes an oldest one of the TCS_B_Aves every time a new TCS_B_Ave is supplied to the TCS_Ave calculating section 206. With the configuration, the TCS_Ave calculating section 206 calculates, as a TCS_Ave, a moving average of the TCS_B_Aves, and the TCS_Ave serves as a moving average of TCSs.

In a process control, the gain adjusting section 301 adjusts a control voltage (i.e., a gain adjustment is made) so that a latest TCS_Ave, which has been calculated by the TCS_Ave calculating section 206, becomes equal to the reference value (in this case, "128") of the toner density detecting sensor 119, without sampling a sensor output of the toner density detecting sensor 119.

Figure 19:
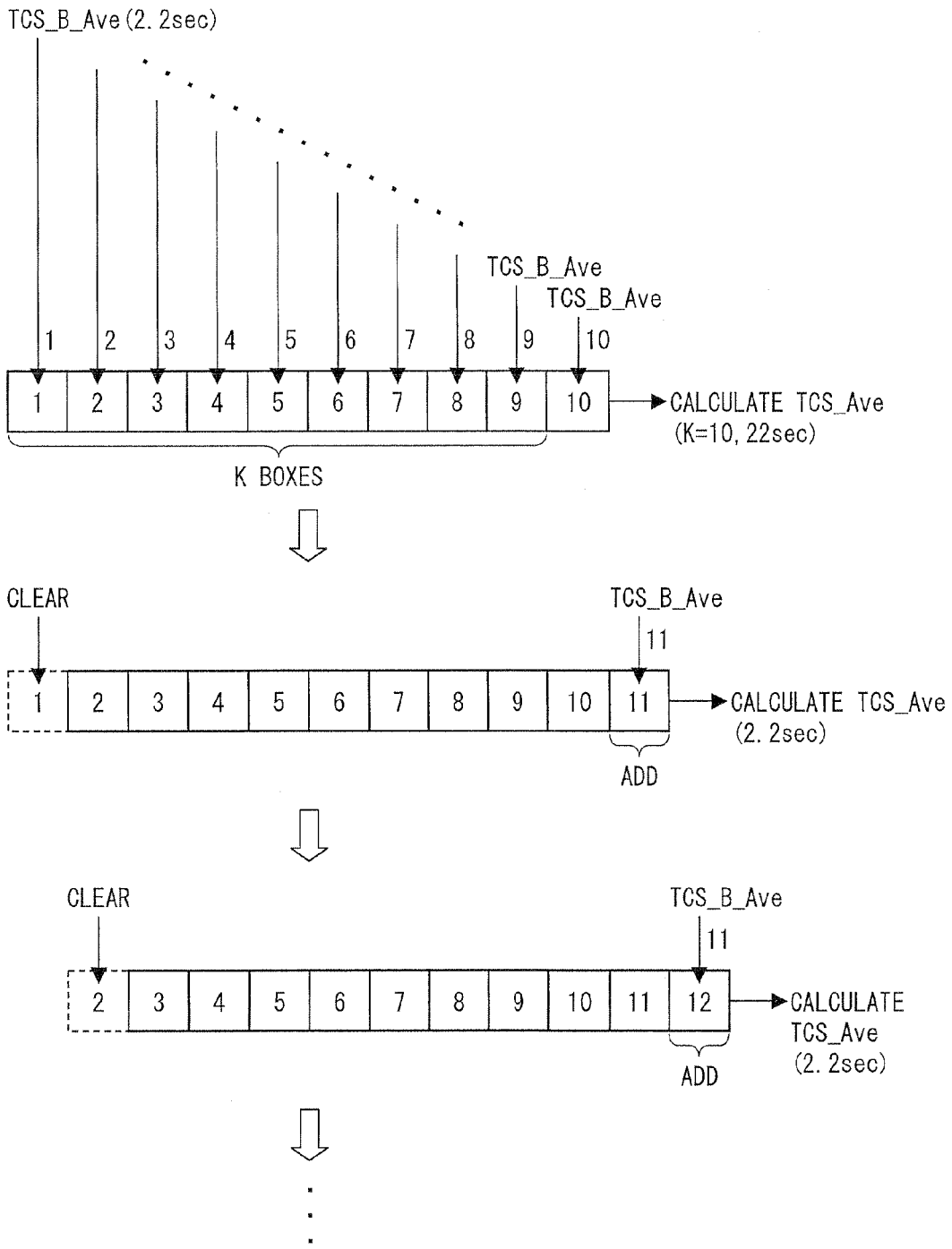
FIG. 19 is a view illustrating an outline of how a TCS_Ave is calculated by a TCS_Ave calculating section included in the image forming apparatus of the another embodiment.

FIG. 19 illustrates how a TCS_Ave is calculated by the TCS_Ave calculating section 206. The TCS_Ave calculating section 206 has K boxes, where "K" corresponds to the number of blocks obtained by dividing the time period corresponding one (1) circulation period. TCS_B_Aves, which have been calculated by the TCS_B_Ave calculating section 202, are sequentially supplied into the boxes from the first box. In the present embodiment, as early described, the TCS_B_Aves are calculated every 2.2 msec. The time period corresponding to one (1) circulation period is divided into "10" blocks, and therefore 10 boxes are filled, one by one, every 2.2 msec. That is, it takes 22 msec (=2.2 msec×10) for all the 10 boxes to be filled. After the 10 boxes are filled, the TCS_B_Aves in the 10 boxes are summed up and then divided by 10 so as to calculate an average (i.e., TCS_Ave) of TCSs for the time period corresponding to one (1) circulation period.

An eleventh TCS_B_Ave is supplied into an eleventh box. In sync with the supply of the eleventh TCS_B_Ave into the eleventh box, the oldest TCS_B_Ave, which is stored in the first box, is cleared, and then a next TCS_Ave is calculated based on the TCS_B_Aves stored in respective of the second through eleventh boxes (i.e., 10 boxes in total). Similarly, a twelfth TCS_B_Ave is supplied into a twelfth box. In sync with the supply of the twelfth TCS_B_Ave into the twelfth box, the second TCS_B_Ave, which is stored in the second box, is cleared, and then a next TCS_Ave is calculated based on the TCS_B_Aves stored in respective of the third through twelfth boxes (i.e., 10 boxes).

As above described, in the case where the 10 boxes are empty, it takes 22 msec (=2.2 msec×10) for calculating a TCS_Ave, and after the 10 boxes are filled, each TCS_Ave is calculated at time intervals (i.e., 2.2 msec) identical with those for calculating a TCS_B_Ave.

The following description will discuss the TCS_Ave storing section 207. The TCS_Ave calculating section 206, which is made up of an SRAM, cannot maintain the TCS_B_Aves stored in the 10 boxes, in cases where (i) the power source of the image forming apparatus is turned off or (ii) supply of electric power from the power source is cut off because the image forming apparatus is entered into a mode such as a sleep mode or a night mode.

It should be noted that, as early described, a TCS_Ave is necessary for making a gain adjustment in a process control. Furthermore, the process control can be carried out (i) immediately after the power source is turned on or (ii) at timing when the image forming apparatus has awaken from the sleep mode or from the night mode. It is therefore preferable that the TCS_Aves are maintained.

In view of the circumstances, the TCS_Ave storing section 207 is configured to control an EEPROM (not illustrated) to store a latest TCS_Ave, which has been calculated by the TCS_Ave calculating section 206, before the supply of electric power from the power source to the SRAM is cut off.

The EEPROM used in the TCS_Ave storing section 207 can be included in the image forming apparatus. Alternatively, in a case where an EEPROM is provided in a toner bottle which is replaceably attached to the toner supply device 22, the EEPROM in the toner bottle can be used.

The TCS_Ave storing section 207 reads out the latest TCS_Ave from the EEPROM (the first or the second EEPROM) when the power source of the image forming apparatus is next turned on or when the image forming apparatus has awaken from the sleep mode or the night mode, and then write TCS_B_Aves, derived from the latest TCS_Ave, into the respective 10 boxes of the TCS_Ave calculating section 206.

With the configuration, the TCS_Ave calculating section 206 can calculate a TCS_Ave immediately after the power source is turned on or immediately after the image forming apparatus has awaken from the sleep mode or the night mode. The gain adjusting section 301 can therefore make, without any problem, a gain adjustment based on the TCS_Ave which has been stored in the EEPROM (the first or the second EEPROM), even in a case where a process control is carried out immediately after the power source is turned on or immediately after the image forming apparatus has awaken from the sleep mode or the night mode.

It should be noted that the TCS_Ave storing section 207 stores the latest TCS_Ave in the form of "quotient" and "remainder" so that a storage area of the EEPROM (the first or the second EEPROM), in which the TCS_Ave is stored, can be reduced.

In a case where, for example, 10 TCS_B_Aves as shown in (a) of FIG. 20 are stored in the respective 10 boxes of the TCS_Ave calculating section 206 when the power source is turned off, the EEPROM (the first or the second EEPROM) requires a storage area of 10 bytes for storing the 10 TCS_B_Aves as they are.

In such a case, the TCS_Ave storing section 207 stores a TCS_Ave of "126.7" in the form of a quotient "126" and a remainder "7" (see (b) of FIG. 20) so that the storage area can be reduced. This merely necessitates 2 bytes for the storage area in the EEPROM (the first or the second EEPROM).

When the power source is turned on again, the TCS_Ave storing section 207 supplies (expands) 10 TCS_B_Aves into the respective 10 boxes of the TCS_Ave calculating section 206. In this case, "126" (corresponding to the quotient "126") is supplied into each of the 10 boxes, and then "1" is added to each of 7 boxes (corresponding to the remainder "7") out of the 10 boxes.

Consequently, when the power source is turned on again, the 10 TCS_B_Aves stored in the respective 10 boxes of the TCS_Ave calculating section 206 become as shown in (c) of FIG. 20. (c) of FIG. 20 merely illustrates a case where the remainder is supplied into each of the first through seventh boxes (sequence).

As is clear from a comparison between (a) and (c) of FIG. 20, some of the 10 TCS_B_Aves stored in the respective 10 boxes of (a) of FIG. 20 are slightly different from those of (c) of FIG. 20. However, the TCS_Ave calculated from the 10

TCS_B_Aves of (c) of FIG. 20 is of course identical with that of (a) of FIG. 20. Note that a TCS_Ave subsequently calculated until all of the 10 TCS_B_Aves shown in (c) of FIG. 20 are replaced by newly supplied 10 TCS_B_Aves is slightly different from that calculated when all of 10 TCS_B_Aves are exactly replaced by the TCS_B_Aves shown in (a) of FIG. 20 when the power source is turned on again. This, however, will never adversely affect accuracy in the gain adjustment, and such a slight difference falls within a range of error.

As above described, the TCS_Ave calculating section 206 calculates a moving average of sensor outputs of the toner density detecting sensor 119 for each time period of not shorter than the time period corresponding to one (1) circulation period, and the gain adjusting section 301 adjusts, in a process control, a control voltage, which is applied to the toner density detecting sensor 119, so that a calculated moving average becomes equal to the reference value of the output of the toner density detecting sensor 119.

With the configuration, it is possible to make a gain adjustment in a process control without any problem, even in a case where a toner density of the developer in the developing tank 111 is nonuniform due to, for example, the fact that toner has been supplied immediately before the process control.

Embodiment 3

The following describes an embodiment of the present invention with reference to drawings. For convenience, the same reference numerals are given to members which have functions identical with those employed in Embodiments 1 and 2.

Figure 21:
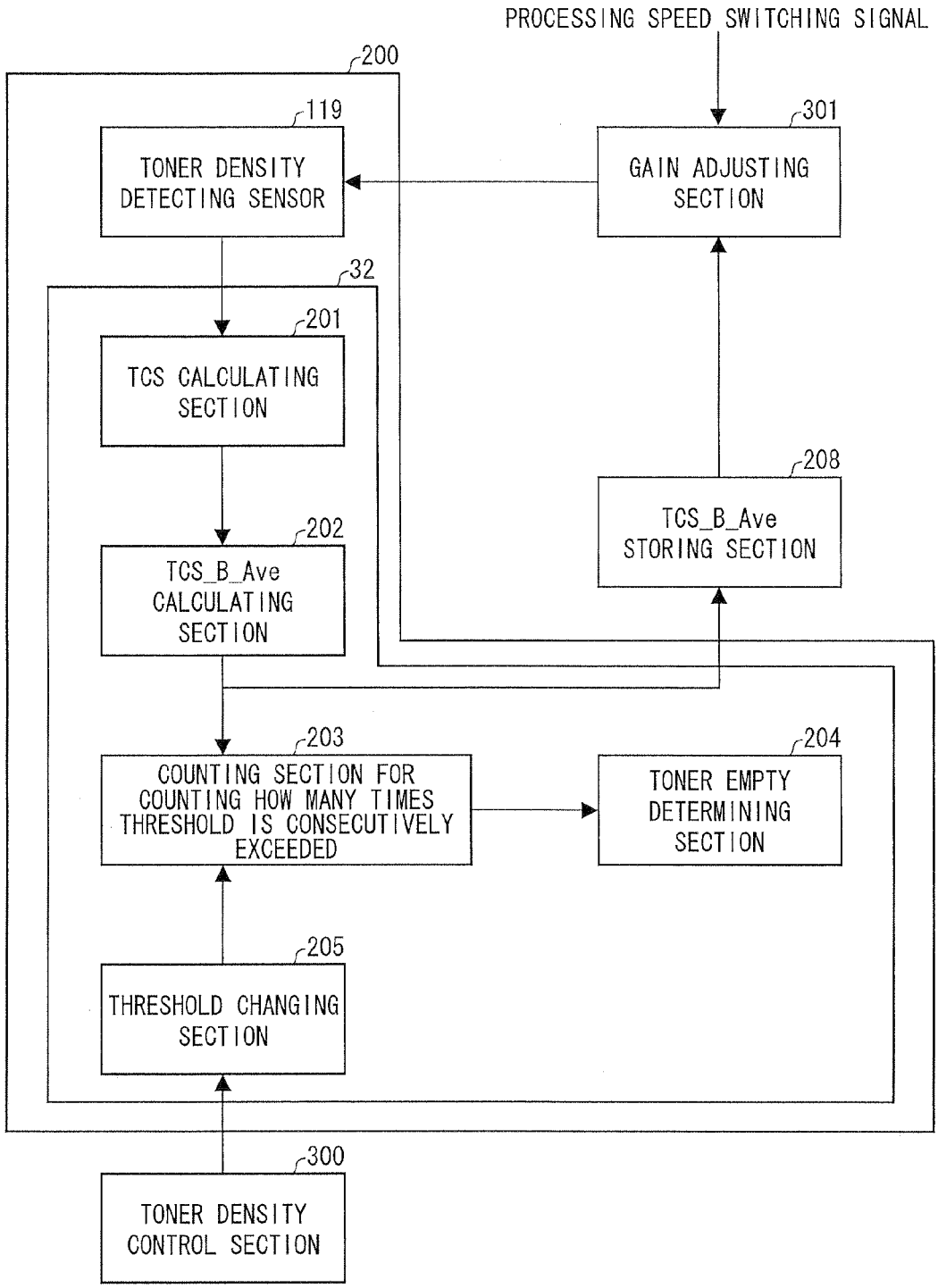
FIG. 21 is a block diagram illustrating a configuration of a toner empty detecting section, a gain adjusting section which adjusts a control voltage applied to a toner density detecting sensor, and the peripheries in an image forming apparatus, in accordance with yet another embodiment of the present invention.

An image forming apparatus in accordance with Embodiment 3 of the present invention has a configuration basically identical with that of the image forming apparatus 100 of Embodiment 1, except that (i) the image forming apparatus of Embodiment 3 further includes a TCS_B_Ave storing section (block average storing section) 208 (see FIG. 21) and (ii) a gain adjusting section 301 of Embodiment 3, which adjusts a sensor output of the toner density detecting sensor 119 by adjusting a control voltage applied to the toner density detecting sensor 119, makes, when a processing speed is changed, a gain adjustment based on a TCS_B_Ave stored in the TCS_B_Ave storing section 208.

The image forming apparatus of Embodiment 3 has a plurality of processing speeds each of which is selected in accordance with a corresponding mode of the image forming apparatus. The processing speed is equal to a peripheral speed of the photoreceptor drum 3. For example, a processing speed in a thick paper mode, in which a printing is carried out with respect to a thick sheet of paper, is slower than a processing speed at which a printing is carried out with respect to a sheet of plain paper.

The following description will discuss an image forming apparatus of the present embodiment in which one of two processing speeds of "low speed (Low)" and "medium speed (Mid)" is selected and used. Note that the image forming apparatus of the present embodiment is not limited to this, and therefore the image forming apparatus can be configured so that one of three or more processing speeds is selected.

In the case where the processing speed is switched between the "low speed (Low)" and the "medium speed (Mid)", a speed at which the developer is carried (hereinafter, referred to as "developer carrying speed") in the developing device 2 is accordingly switched between a "low speed (Low)" and a "medium speed (Mid)," respectively.

A problem lies in the fact that, in a case where the developer carrying speed is changed, a sensor output of the toner density detecting sensor 119 changes, even though there is no change in toner density.

Figure 22:
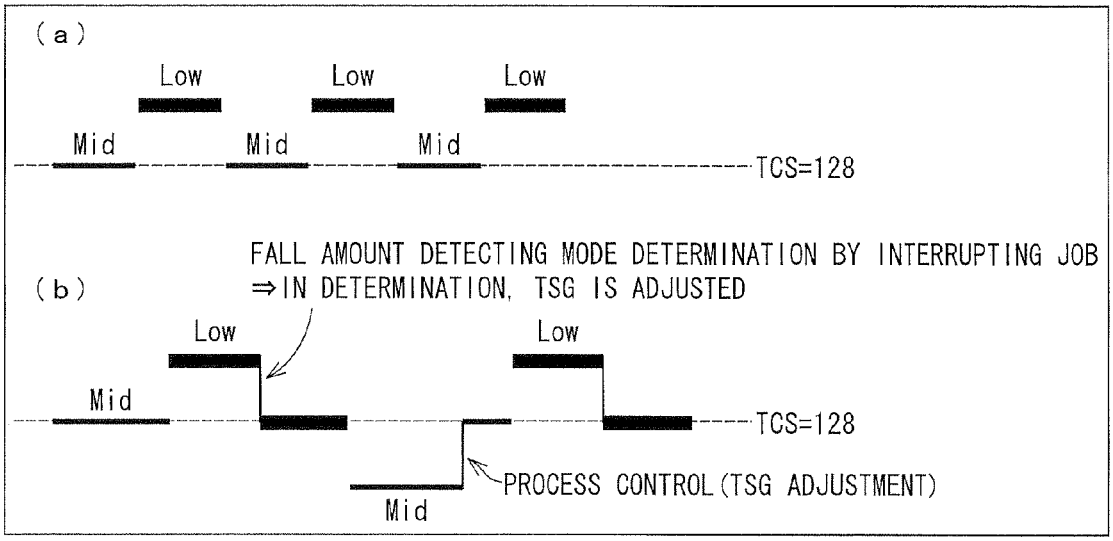
FIG. 22 Each of (a) and (b) of FIG. 22 illustrates that a sensor output of the toner density detecting sensor is changed in accordance with a change in processing speed.

A sensor output of "128", which was detected when the developer carrying speed was "medium speed (Mid)", becomes higher when the developer carrying speed is changed to "low speed (Low)" (see (a) of FIG. 22). That is, even though a toner density of the developer has not changed, the sensor output changes as if the toner density had decreased.

A sensor output of "128", which was detected when the developer carrying speed was "low speed (Low)", becomes lower when the developer carrying speed is changed to "medium speed (Mid)" (this case is not illustrated). That is, even though a toner density of the developer has not changed, the sensor output changes as if the toner density had increased.

As described in Embodiment 1, the toner empty detecting section 200 calculates TCS_B_Aves and determines toner empty based on how many times the TCS_B_Aves consecutively exceed the threshold.

However, toner empty cannot be accurately determined, in a case where a sensor output of the toner density detecting sensor 119 is thus changed according to the change in the developer carrying speed, although there is no change in toner density of the developer.

This will be described below in more detail. In a case where, for example, the sensor output becomes higher when the developer carrying speed is changed from the "medium speed (Mid)" to the "low speed (Low)" (see (a) of FIG. 22), a TCS_B_Ave becomes more likely to exceed the threshold, and therefore the counter in the counting section 203 is more likely to increase its counted value. Even when a TCS_B_Ave becomes lower in response to toner supply, the TCS_B_Ave is less likely to be decreased below the threshold because the sensor outputs become wholly high. This causes the counter in the counting section 203 to be less likely to reset its counted value. As a result, even though toner has not run short, the counted value of the counter in the counting section 203 reaches the determination value, and therefore toner empty is wrongly determined (detected).

On the other hand, in a case where the sensor output becomes lower when the developer carrying speed is changed from the "low speed (Low)" to the "medium speed (Mid)", a TCS_B_Ave becomes less likely to exceed the threshold, and therefore the counter in the counting section 203 is less likely to increase its counted value. As a result, even though toner has run short, the counted value of the counter in the counting section 203 does not reach the determination value, and therefore a detection of toner empty is delayed.

Note that such a change (deviation) in the sensor output of the toner density detecting sensor 119 caused by the change in the developer carrying speed is corrected by a gain adjustment made (i) in a fall amount detecting mode determination in which an amount of fallen toner is measured and (ii) in a process control (see (b) of FIG. 22). Note that the fall amount detecting mode determination and the process control are carried out while a job is interrupted. That is, such a change (deviation) in the sensor output of the toner density detecting sensor 119 is corrected by adjusting a control voltage so that the sensor output of the toner density detecting sensor 119 becomes equal to the median of "128" expressed by 8-bit.

However, it is just conceivable that the wrong detection or the delay in detection as early described is caused before the fall amount detecting mode determination or the process control is carried out. It is therefore necessary to take countermeasures to meet the situation.

In the case where, in particular, TCS_B_Aves are calculated and toner empty is determined based on how many times the TCS_B_Aves consecutively exceed the threshold, the counted value of the counter in the counting section 203 is carried over and used in a different job(s), instead of being reset.

It should be noted that, in a case where the TCS_B_Aves become more likely to or less likely to exceed the threshold due to the fact that the sensor output is changed according to a change in the developer carrying speed, there occurs a problem that it becomes impossible that the counted value of the counter in the counting section 203 is carried over and used in a different job(s). In order to address such a problem, it is necessary to set thresholds for the respective processing speeds.

However, it is difficult to accurately set the thresholds for the respective processing speeds so that the counted value of the counter in the counting section 203 is carried over and used at the different processing speeds.

In order to address the problem, the image forming apparatus of the present embodiment stores, when a job is ended, a latest TCS_B_Ave calculated by the TCS_B_Ave calculating section 202, in preparation for a change in the processing speed. When the processing speed is actually changed, a sensor output of the toner density detecting sensor 119 is sampled, and then a control voltage is adjusted (i.e., a gain adjustment is made) so that a sampled sensor output becomes equal to the latest TCS_B_Ave which has been stored in the TCS_B_Ave storing section 208 when the previous job is ended.

This causes the sensor output of the toner density detecting sensor 119 to be adjusted to become equal to the latest TCS_B_Ave which has been stored before the processing speed is changed, even when the processing speed is changed. It follows that toner shortage can be determined based on how many times the TCS_B_Aves consecutively exceed the threshold with the use of a threshold commonly used at the different processing speeds.

The following description will discuss, in more detail, a configuration which enables such a gain adjustment. The image forming apparatus of the present embodiment includes the TCS_B_Ave storing section 208, in addition to the toner empty detecting section 200 (see FIG. 21). The toner empty detecting section 200 and the TCS_B_Ave storing section 208 constitute the monitoring/detecting section.

The TCS_B_Ave storing section 208 stores, every time a job is ended, a latest TCS_B_Ave calculated by the TCS_B_Ave calculating section 202.

The gain adjusting section 301 (i) samples sensor outputs of the toner density detecting sensor 119 in response to a processing speed switching signal and then (ii) adjusts a control voltage, which is applied to the toner density detecting sensor 119 (i.e., a gain adjustment is made), so that a sampled sensor output becomes equal to the TCS_B_Ave stored in the TCS_B_Ave storing section 208.

Figure 23:
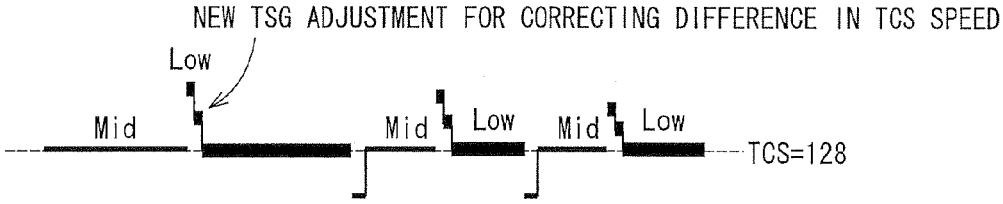
FIG. 23 is a view illustrating adjustment of control voltage applied to the toner density detecting sensor which is made, when a processing speed is changed, by a gain adjusting section included in the image forming apparatus of the yet another embodiment.

Since the above gain adjustment is made each time the processing speed is changed, the sensor output of the toner density detecting sensor 119 is adjusted, every time the processing speed is changed, so that the sensor output becomes equal to (i.e., follows) a latest TCS_B_Ave calculated in a job which has been carried out immediately before the processing speed is changed (see FIG. 23).

Figure 24:
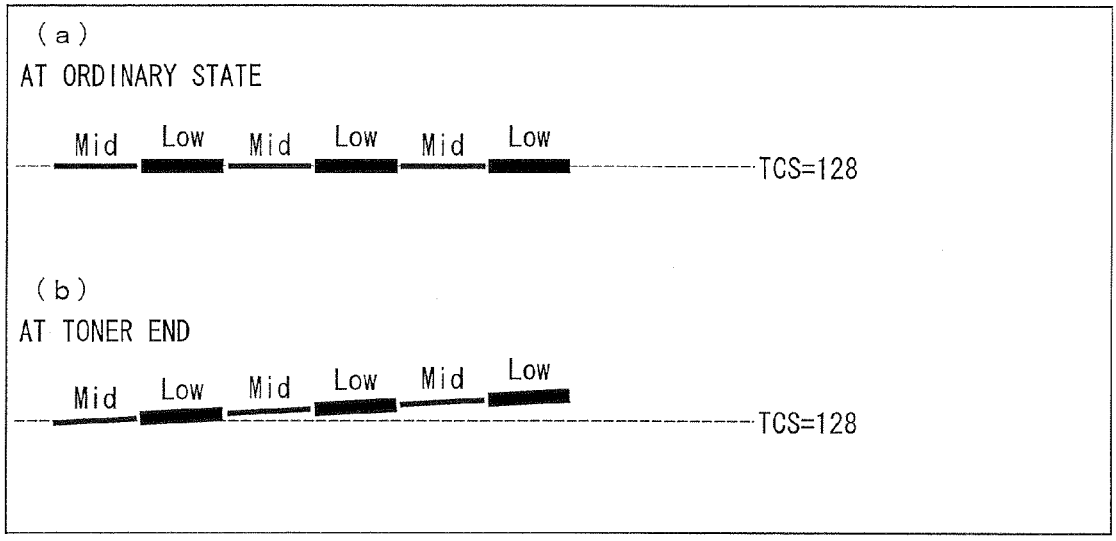
FIG. 24 Each of (a) and (b) of FIG. 24 is a view illustrating how a sensor output is changed in response to control voltage adjustments which are made, when the processing speed is changed, by the gain adjusting section included in the image forming apparatus of the yet another embodiment.

Specifically, in a case where toner to be supplied sufficiently remains in the toner supply device 22, the sensor output of the toner density detecting sensor 119, even when the above gain adjustment is made, is kept to be the median of "128" expressed by 8-bit (see FIG. 24 (*a*)). This is because calculated TCS_B_Aves are near the median "128" expressed by 8-bit.

On the contrary, calculated TCS_B_Aves gradually become higher than the median of "128", as an amount of toner to be supplied becomes nearer toner empty (i.e., close to a toner end), (see FIG. 24 (*b*)). Accordingly, the sensor output of the toner density detecting sensor 119 gradually becomes higher in response to the gain adjustments.

The TCS_B_Ave storing section 208 causes an EEPROM to store a TCS_B_Ave, for bringing about an effect similar to that of the TCS_Ave storing section 207 of Embodiment 2. That is, with the configuration in which the TCS_B_Ave is stored in the EEPROM, it is possible to maintain the TCS_B_Ave even when the supply of electric power from the power source to an SRAM of the control section is cut off because the power source of the image forming apparatus is turned off or the image forming apparatus is entered into the sleep mode, the night mode, or the like.

This allows the gain adjustment by which the sensor output becomes equal to the TCS_B_Ave of the previous job, even when the developer carrying speed is changed immediately after the power source is turned on or at timing when the image forming apparatus has awaken from the sleep mode or from the night mode.

Note that the gain adjustment, which is made when the processing speed is changed, is not limited to the configuration in which the gain adjustment is made in both cases where the processing speed is changed (i) from the low speed (Low) to the medium speed (Mid) and (ii) from the medium speed (Mid) to the low speed (Low). The gain adjustment can be made, for example, in only one of the above cases (i) and (ii) which affects a detection of toner empty more adversely than the other.

Also note that, in a case where (i) the TCS_B_Ave storing section 208 stores a TCS_B_Ave at the end of a job and (ii) the latest TCS_B_Ave is calculated by sampling a sensor output of the toner density detecting sensor 119 which has detected a magnetic permeability of the developer in a region where supplied toner was unevenly distributed (see the blocks (5) and (6) of (b) of FIG. 15), the TCS_B_Ave storing section 208 maintains a TCS_B_Ave of a previous job, instead of storing a latest TCS_B_Ave of the current job.

With the configuration, it is possible to make, without any problem, a gain adjustment in which an identical TCS_B_Ave is kept between respective consecutive two jobs, even in a case where a latest TCS_B_Ave is calculated at the end of a job based on a sensor output of the toner density detecting sensor 119 which has detected a magnetic permeability of the developer in a region where supplied toner was unevenly distributed.

Figure 25:
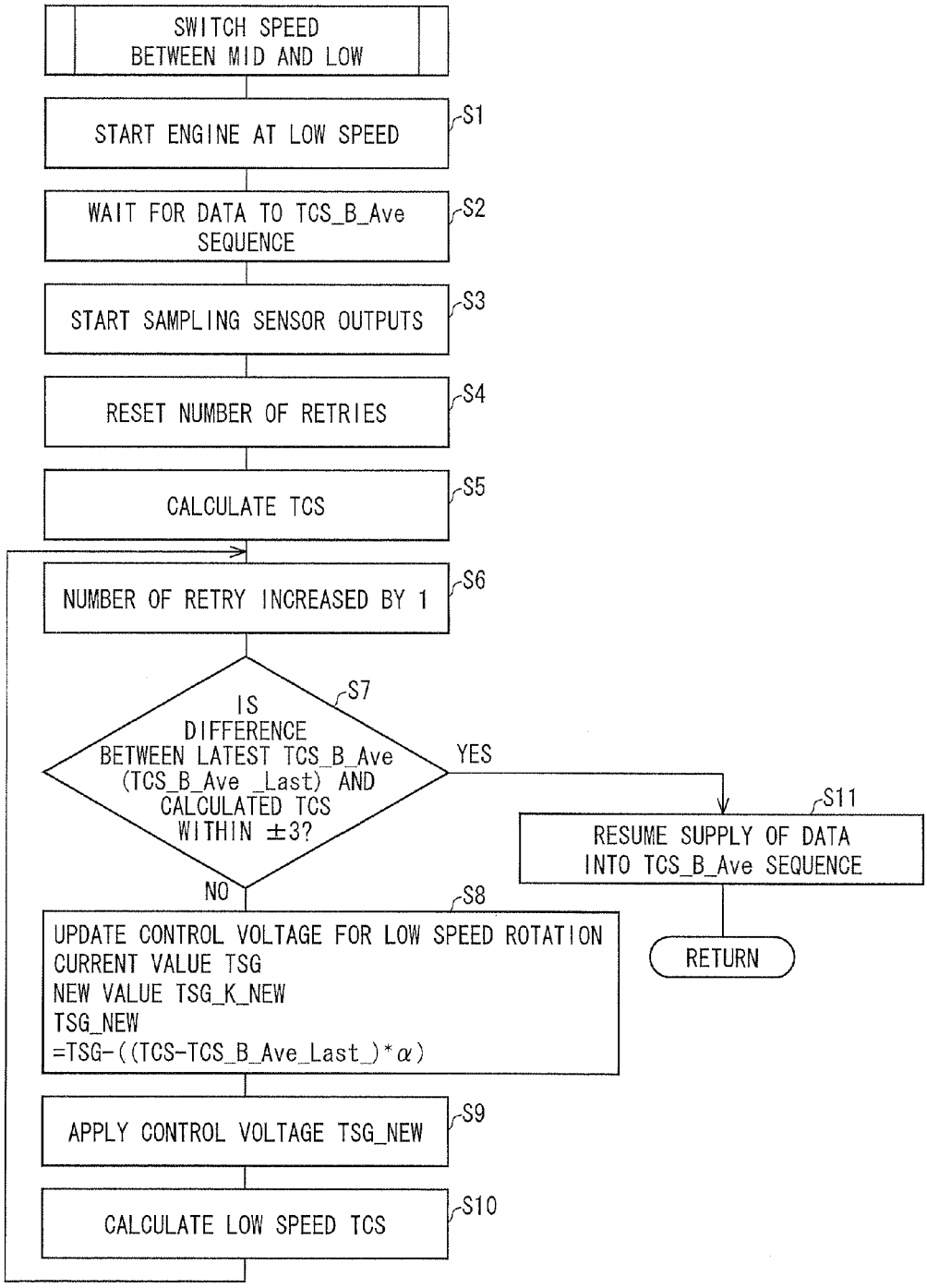
FIG. 25 is a flowchart illustrating a subroutine carried out when the processing speed is changed in the image forming apparatus of the another embodiment.

FIG. 25 is a flowchart illustrating a speed switching process (subroutine) which is carried out for switching the processing speed from the medium speed (Mid) to the low speed (Low).

A motor, which drives the first carrying member 112 and the second carrying member 113 of the developing device 2, is started at a low speed (S1), and the TCS_B_Ave calculating section 202 waits for data (TCS) which is to be supplied into a TCS_B_Ave sequence (i.e., M boxes illustrated in FIG. 11) (S2).

Subsequently, the TCS calculating section 201 starts to sample a sensor output (S3), and the number of retries is reset (S4). Note that "the number of retries" is how many times of retry were needed for a gain adjustment to be completed.

After that, the TCS calculating section 201 calculates a TCS (S5), and the number of retries is increased by one (S6). Then, the control device 32 reads out a TCS_B_Ave from the TCS_B_Ave storing section 208, and compares the TCS_B_Ave with the TCS calculated in the step S5 (S7). In a case where a difference between the TCS_B_Ave and the TCS is, for example, "3" or less, the TCS is judged to be equal to the TCS_B_Ave, and the process proceeds to a step S11.

On the contrary, in a case where the difference between the TCS_B_Ave and the TCS is more than "3" in the step S7, the TCS is judged to be unequal to the TCS_B_Ave, and the process proceeds to a step S8. In the step S8, a new control voltage is calculated, by subtracting an adjustment voltage, which varies depending on the above difference, from a current control voltage, such that the TCS calculated in the step S5 becomes equal to the TCS_B_Ave read out from the TCS_B_Ave storing section 208.

The new control voltage calculated in the step S8 is applied to the toner density detecting sensor 119 (S9), and a TCS is again calculated (S10). After that, the number of retries is increased by one (S6), and then the control device 32 compares the TCS_B_Ave, which has been read out from the TCS_B_Ave storing section 208, with the TCS calculated in the step S10 (S7). The steps S7 through S10 and S6 are repeated until the judgment in the step S7 becomes "YES".

As early described, in a case where the difference falls within a tolerance in the step S7, the TCS is judged to be equal to the TCS_B_Ave, and the process proceeds to the step S11. In the step S11, the supply of data (TCS) into the TCS_B_Ave sequence is resumed. After that, the process returns to a main routine (not illustrated) from the subroutine which has been executed when the processing speed is changed.

Figure 26:
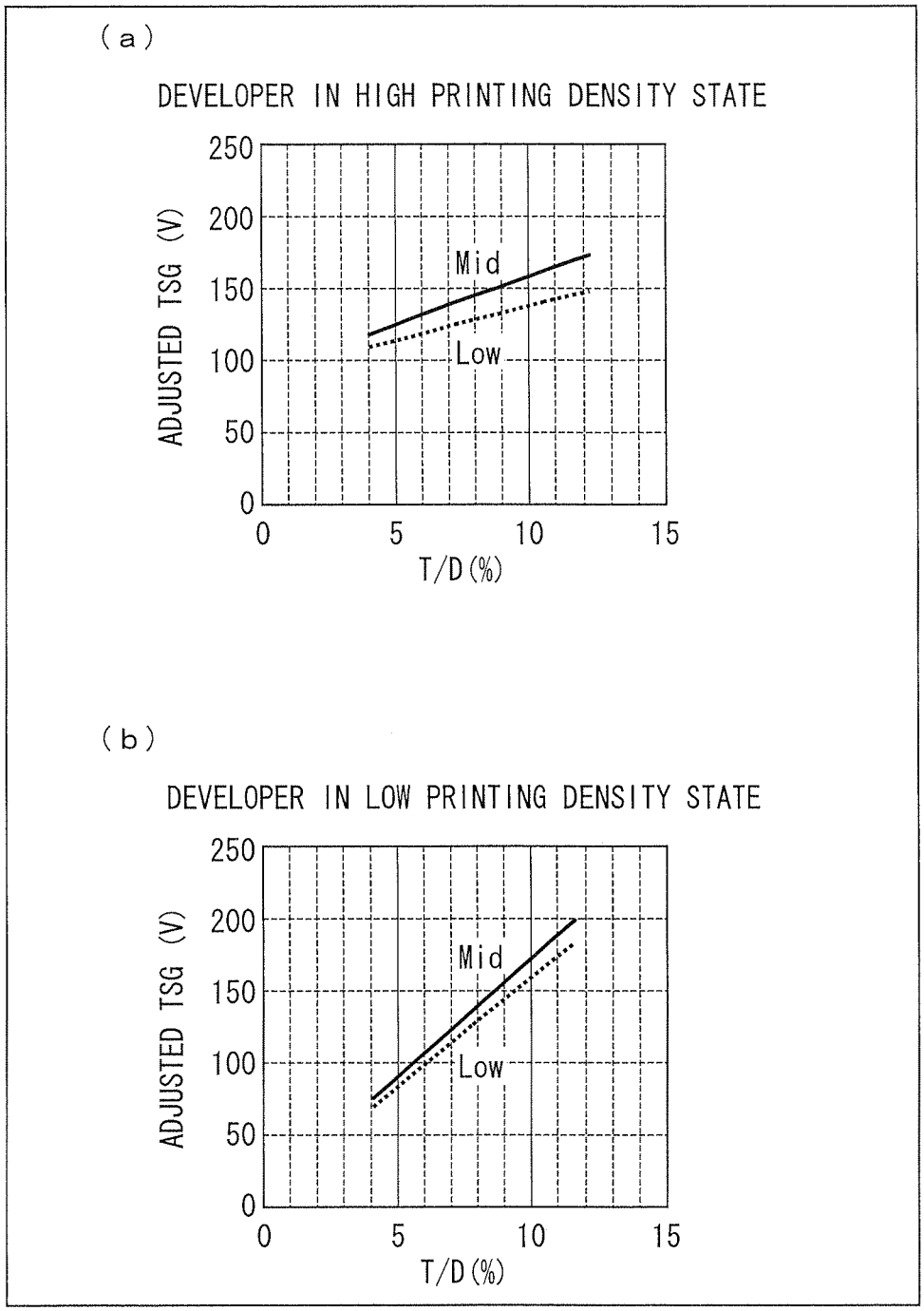
FIG. 26 Each of (a) and (b) of FIG. 26 is a graph illustrating a relation between a toner density and an adjusted control voltage.

Each of (a) and (b) of FIG. 26 illustrates a relation between a toner density and a control voltage which has been adjusted. (a) of FIG. 26 is a graph illustrating developer in a state where a printing density is high, and (b) of FIG. 26 is a graph illustrating developer in a state where a printing density is low. As is clear from a comparison between (a) and (b) of FIG. 26, a difference in control voltage (TSG) between at a medium speed (Mid) and at a low speed (Low) is larger in the high printing density state than in the low printing density state. This shows that such a gain adjustment, which is made when the processing speed is changed, can become more effective in a case where high printing density jobs are consecutively carried out.

As above described, the TCS_B_Ave storing section 208 controls, every time a job is ended, a nonvolatile memory to store a latest TCS_B_Ave. The gain adjusting section 301 samples, when the processing speed is changed, a sensor output of the toner density detecting sensor 119 and adjusts a control voltage, which is applied to the toner density detecting sensor 119, so that a sampled sensor output becomes equal to the TCS_B_Ave stored in the TCS_B_Ave storing section 208.

According to the configuration, when the processing speed is changed, the sensor output of the toner density detecting sensor 119 is adjusted to become equal to the latest TCS_B_Ave of a job which has been carried out immediately before the processing speed is changed. This allows a detection of toner shortage based on how many times a single threshold is consecutively exceeded, which single threshold common used at different processing speeds.

The image forming apparatus of each of Embodiments 1 through 3 can be realized by a computer. In this case, the present invention encompasses (i) a program which causes the computer to function as the means/sections of the image forming apparatus and (ii) a computer-readable storage medium which stores the program.

That is, in the image forming apparatus of each of Embodiments 1 through 3, the sections such as the toner empty detecting section 200, the TCS_Ave calculating section 206, the TCS_Ave storing section 207, and the TCS_B_Ave storing section 208 can be realized by software with the use of a processor such as a CPU. In this case, the image forming apparatus of each of Embodiments 1 through 3 includes a CPU (central processing unit), a ROM (read only memory), a RAM (random access memory), and a storage device (storage medium) such as a memory. The CPU executes instructions of control programs for realizing the functions of the toner empty detecting section 200, the TCS_Ave calculating section 206, the TCS_Ave storing section 207, and the TCS_B_Ave storing section 208. In the ROM, the programs are stored. Into the RAM, the programs are loaded. In the storage device, the programs and various data are stored.

The objective of the present invention can also be achieved, by (i) supplying a storage medium, in which program codes (executable programs, intermediate code programs, source programs) of programs for controlling the image forming apparatus of each of Embodiments 1 through 3, each being configured by software for realizing the functions, are stored so that a computer can read them, to the image forming apparatus of each of Embodiments 1 through 3, and then (ii) causing the computer (or CPU or MPU) to read and execute the program codes stored in the storage medium.

The storage medium can be, for example, a tape, such as a magnetic tape or a cassette tape; a disk including (i) a magnetic disk such as a Floppy (Registered Trademark) disk or a hard disk and (ii) an optical disk such as CD-ROM, MO, MD, DVD, or CD-R; a card such as an IC card (memory card) or an optical card; or a semiconductor memory such as a mask ROM, EPROM, EEPROM, or flash ROM.

Alternatively, the image forming apparatus of each of Embodiments 1 through 3 can be arranged to be connected to a communications network so that the program codes are delivered over the communications network. The communications network is not limited to a specific one, and therefore can be, for example, the Internet, an intranet, extranet, LAN, ISDN, VAN, CATV communications network, virtual private network, telephone line network, mobile communications network, or satellite communications network. The transfer medium which constitutes the communications network is not limited to a specific one, and therefore can be, for example, wired line such as IEEE 1394, USB, electric power line, cable TV line, telephone line, or ADSL line; or wireless such as infrared radiation (IrDA, remote control), Bluetooth (Registered Trademark), 802.11 wireless, HDR, mobile telephone network, satellite line, or terrestrial digital network. Note that, the present invention can be realized by a computer data signal (i) which is realized by electronic transmission of the program code and (ii) which is embedded in a carrier wave.

In the image forming apparatus of each of Embodiments 1 through 3, the sections (means) such as the toner empty detecting section 200, the TCS_Ave calculating section 206, the TCS_Ave storing section 207, the TCS_B_Ave storing section 208 are not limited to those realized by using software. It is therefore possible to configure the sections by (i) hardware logic or (ii) a combination of (a) hardware which partially carries out processes and (b) operation means for executing software which controls the hardware and carries out the other of the processes.

As early described, with the method of the present invention for detecting toner shortage, it is possible to detect toner shortage without delay, regardless of a positional relation between the toner supply inlet and the magnetic permeability sensor, by appropriately setting a time length of each of the plurality of blocks, the threshold, and the determination value based on which toner shortage is determined.

In this case, it is preferable that a time width of each of the plurality of blocks is set (i) so as to eliminate noise and (ii) such that, in a case where toner is supplied while the averages of the sensor outputs are consecutively exceeding the threshold, an average, obtained by calculation based on sampled sensor outputs of the magnetic permeability sensor which has detected a magnetic permeability of the developer in a region where supplied toner is unevenly distributed, becomes not more than the threshold.

With the configuration, it is possible to avoid a case where (i) a toner supply is wrongly detected due to a noise in which the sensor output of the magnetic permeability sensor is decreased regardless of an actual toner density of the developer, and therefore (ii) the measured number of times that the threshold has been consecutively exceeded is reset by the wrong detection.

Moreover, in a case where toner is supplied while the block averages are consecutively exceeding the threshold, such a toner supply can be certainly detected, and therefore the measured number of times that the threshold has been consecutively exceeded can be reset.

With the configuration, it is possible to certainly detect toner supply, even in a case where (i) a magnetic permeability of the developer wholly becomes high because toner becomes close to shortage and therefore (ii) the threshold becomes more likely to be consecutively exceeded. This allows a case to be avoided that toner shortage is incorrectly detected, although toner to be supplied still remains.

Moreover, in this case, it is further preferable that the time width of each of the plurality of blocks is set such that the average which is not more than the threshold is consecutively calculated a plurality of times.

This makes it possible to employ a configuration in which the measured number of times that the threshold has been consecutively exceeded is reset, in a case where the block average which is not more than the threshold is consecutively calculated a plurality of times. This allows a case to be avoided in which (i) toner supply is incorrectly detected due to noise which cannot be eliminated by the setting of block average and therefore (ii) the measured number of times that the threshold has been consecutively exceeded is incorrectly reset.

In the method of the present invention for determining toner shortage, it is preferable that the threshold is set as an additional value to be added to the reference value of the sensor outputs of the magnetic permeability sensor; the number of blocks, based on which toner shortage is determined, is set to be small when the additional value is high; and the number of blocks, based on which the toner shortage is determined, is set to be large when the additional value is low.

As early described, the number of blocks based on which toner shortage is determined needs to be not less than the number of blocks corresponding to the time period corresponding to one (1) circulation period. The threshold in which the additional value becomes higher means that the threshold is set to be exceeded in a state where a toner density of the developer is largely decreased. In such a state, toner should be supplied immediately, and therefore toner shortage can be determined after elapse of a time period corresponding to, for example, the number of blocks which correspond to the time period corresponding to one (1) circulation period. On the other hand, the threshold in which the additional value becomes lower means that the threshold is set to be exceeded in a state where a toner density of the developer is slightly decreased. In such a case, toner does not need to be supplied immediately, and, if toner is supplied, an amount of toner supplied may be too small to cause the averages of the sensor outputs to become lower than the threshold. Therefore, in a case where such a threshold is used, it is preferable that toner shortage is determined after elapse of a time period corresponding to, for example, the number of blocks which correspond to the time period corresponding to three to four circulation periods.

According the image forming apparatus of the present invention, as with the method for determining toner shortage, it is possible to detect toner shortage without delay by appropriately setting a time width of each of the plurality of blocks, the threshold, and the determination value based on which the toner shortage is determined, regardless of a positional relation between the toner supply inlet and the magnetic permeability sensor. It is therefore possible to suppress an occurrence of carriers being adhered to the photoreceptor due to a decrease in toner density.

In the image forming apparatus of the present invention also, it is preferable that each of the plurality of blocks is set (i) so as to eliminate a noise and (ii) such that, in a case where toner is supplied while the averages of the sensor outputs are consecutively exceeding the threshold, an average, obtained by calculation based on sampled sensor outputs of the magnetic permeability sensor which has detected a magnetic permeability of the developer in a region where supplied toner is unevenly distributed, becomes not more than the threshold.

Similarly, it is preferable that each of the plurality of blocks is further set such that the average which is not more than the threshold is consecutively calculated a plurality of times.

Moreover, it is preferable that the threshold is set as an additional value to be added to the reference value of the sensor outputs of the magnetic permeability sensor; the number of blocks, based on which toner shortage is determined, is set to be small when the additional value is high; and the number of blocks, based on which the toner shortage is determined, is set to be large when the additional value is low.

In the image forming apparatus of the present invention, it is preferable that the measuring section measures each number of times that block averages consecutively exceed a corresponding one of a plurality of thresholds; and the toner shortage determining section determines that toner has run short, in a case where any of the numbers of times that the measuring section has measured for respective thresholds reaches a corresponding one of a plurality of determination values which are set for the respective plurality of determination values.

According to the configuration, the plurality of thresholds and the plurality of determination values corresponding to the respective plurality of thresholds are set. It is therefore possible to accurately determine toner shortage without delay, in a case where a toner density of the developer is gradually decreased below the threshold until toner shortage and also in a case where a toner density is rapidly decreased below the threshold until toner shortage.

Moreover, the image forming apparatus of the present invention can further includes a threshold changing section which changes the threshold so that the threshold becomes near the reference value, when an amount of toner remaining in the toner supply device becomes not more than a predetermined amount.

When the amount of toner remaining in the toner supply device approaches empty, no toner will be supplied or an insufficient amount of toner will be supplied, in response to an instruction on supplying toner.

According to the configuration, the threshold is changed so that the threshold becomes near the reference value, when the amount of toner remaining in the toner supply device becomes not more than a predetermined amount. Specifically, when the amount of remaining toner reaches an amount at which the toner density control becomes unstable, the threshold changing section changes the threshold so that the threshold approaches the reference value. This allows toner empty to be reliably detected. As such, it is possible to effectively avoid a problem of delay in detection of toner empty.

It is preferable that the image forming apparatus of the present invention further includes: a one-rotation average calculating section which (i) samples sensor outputs of the magnetic permeability sensor at predetermined time intervals each of which is shorter than a time period corresponding to one (1) rotation period required for the developer carrying member to rotate once and (ii) calculates, based on sampled sensor outputs, a one-rotation average each time the developer carrying member rotates, the one-rotation average being an average of the sensor outputs of the magnetic permeability sensor for the time period corresponding to one (1) rotation period, the block average calculating section calculating, as the block average, an average of a predetermined number of one-rotation averages.

According to the configuration, (a) the one-rotation average calculating section (i) samples sensor outputs at the predetermined time intervals each of which is shorter than the time period corresponding to one (1) rotation period required for the developer carrying member to rotate once and (ii) calculates, each time the developer carrying member rotates, a one-rotation average which is an average of sensor outputs for the time period corresponding to one (1) rotation period, and (b) the block average calculating section calculates a block average by using the one-rotation averages.

The rotation of the developer carrying member causes a high concentration region and a low concentration region to alternate in the developer in the circulation carrying path. The alternation causes the magnetic permeability sensor to have a sensor output which changes in an S-curve in sync with a rotation cycle of the developer carrying member. It is possible to eliminate an effect of such fluctuation in sensor output, by calculating the one-rotation average. Furthermore, it is possible to calculate a block average more accurately.

In the image forming apparatus of the present invention, it is possible that the monitoring/detecting section further includes: a moving average calculating section which calculates a moving average by periodically sampling the sensor outputs of the magnetic permeability sensor, the moving average being calculated for each time period not shorter than the time period corresponding to the one (1) circulation period; and a first gain adjusting section which adjusts, when image quality is adjusted, a control voltage applied to the magnetic permeability sensor such that the moving average becomes equal to the reference value.

When image quality is adjusted, sensor outputs of the magnetic permeability sensor are sampled, and the control voltage applied to the magnetic permeability sensor is adjusted such that a sampled sensor output becomes equal to the reference value of the sensor output. That is, a so-called gain adjustment is made.

However, in such a gain adjustment, in a case where a timing at which the sensor output is sampled overlaps a timing at which developer, in which supplied toner is unevenly distributed, passes through the magnetic permeability sensor, the control voltage will be adjusted such that the sensor output, which is remarkably low (i.e., indicative of high toner density) because the sensor output is made by detecting the developer in which the supplied toner is unevenly distributed, becomes equal to the reference value. Consequently, the gain adjustment is made incorrectly.

According to the configuration of the present invention, the moving average calculating section calculates a moving average by periodically sampling the sensor outputs of the magnetic permeability sensor for each time period not shorter than the time period corresponding to the one (1) circulation period. According to the configuration, the moving average is calculated for each time period not shorter than the time period corresponding to the one (1) circulation period. Therefore, even in a case where toner is supplied immediately before the calculation of the moving average, it is possible to average the sensor outputs. Such calculation of moving average is constantly carried for image quality adjustment which will be carried out unexpectedly.

The first gain adjusting section adjusts, when image quality is adjusted, a control voltage such that the moving average calculated by the moving average calculating section becomes equal to the reference value of the sensor outputs of the magnetic permeability sensor.

With the configuration, it is possible to make a gain adjustment in an image quality adjustment without any problem, even in a case where toner has been supplied immediately before the image quality adjustment.

In this case, it is possible that the moving average calculating section calculates a moving average based on block averages calculated by the block average calculating section.

In the case where the block average calculated by the block average calculating section is used, it is possible to easily obtain a moving average for a time period not shorter than the time period corresponding to one (1) circulation period.

In this case, it is preferable that the image forming apparatus of the present invention includes a moving average storing section which controls a nonvolatile memory to store a moving average calculated by the moving average calculating section.

According to the configuration, the moving average storing section controls the nonvolatile memory to store the moving average calculated by the moving average calculating section, and the moving average calculating section calculates a moving average by using the moving average stored in the nonvolatile memory. With the configuration, the moving average can be calculated immediately after a power source of the image forming apparatus is turned on or immediately after the image forming apparatus has awaken from the sleep mode or the night mode. Therefore, even in a case where an image quality adjustment is made at such a timing, a gain adjustment can be made without problem.

In this case, it is further preferable that the moving average is stored in the nonvolatile memory in the form of quotient and remainder.

According to the configuration, the moving average is stored in the form of "quotient" and "remainder". This makes it possible to effectively reduce a used amount of a storage area of the nonvolatile memory.

In the image forming apparatus of the present invention, it is possible that the monitoring/detecting section further includes: a block average storing section which controls, every time a job is ended, a nonvolatile memory to store a latest block average calculated by the block average calculating section; and a second gain adjusting section which (i) samples, when a processing speed is changed, the sensor outputs of the magnetic permeability sensor and (ii) adjusts a control voltage, which is applied to the magnetic permeability sensor, so that an average of sampled sensor outputs becomes equal to the latest block average stored in the block average storing section.

The monitoring/detecting section detects toner shortage based on the number of times that the block averages consecutively exceed the threshold. Therefore, in a case where a sensor output of the magnetic permeability sensor is changed in accordance with change in speed at which the developer is carried (i.e., change in processing speed), a block average will be fluctuated, and there occurs a problem that the threshold is either exceeded or not exceeded even though a toner density of the developer is not actually changed. Under the circumstances, it is necessary to set thresholds for respective processing speeds.

However, the measured number that the threshold has been exceeded, which is used to determine toner shortage, needs to be carried over and used in jobs between which the processing speed is changed. Therefore, it is necessary to accurately set thresholds depending on the processing speeds such that the measured value can be simply carried over, although such accurate setting is difficult.

According to the configuration of the present invention, the nonvolatile memory is, every time a job is ended, controlled to store the latest block average which has been calculated by the block average calculating section. Then, the second gain adjusting section (i) samples sensor outputs of the magnetic permeability sensor when the processing speed is changed, and adjusts a control voltage, which is applied to the magnetic permeability sensor, such that the sensor output becomes equal to the block average stored in the block average storing section.

This causes the sensor output of the magnetic permeability sensor to be adjusted to become equal to the latest block average which has been stored before the processing speed is changed, even when the processing speed is changed. It follows that toner shortage can be determined based on how many times the block averages consecutively exceed the threshold with the use of a threshold commonly used at the different processing speeds.

The present invention is not limited to the embodiments, but can be altered by a skilled person in the art within the scope of the claims. An embodiment derived from a proper combination of technical means disclosed in respective different embodiments (e.g., a combination of Embodiments 2 and 3) is also encompassed in the technical scope of the present invention.

REFERENCE SIGNS LIST

1: Exposure unit
2: Developing device
3: Photoreceptor drum
4: Cleaner unit
5: Charger
32: Control device
33: Imaging counter
35: Dot-counting device
36: Image forming processing section
100: Image forming apparatus
102: Toner transfer mechanism
111: Developing tank
112: First carrying member
112*a*: First carrying blade
112*b*: First rotary shaft
112*c*: Gear
113: Second carrying member
200: Toner empty detecting section
201: TCS calculating section
202: TCS_B_Ave calculating section (block average calculating section)
203: Counting section for counting how many times a threshold is consecutively exceeded
204: Toner empty determining section
205: Threshold changing section
206: TCS_Ave calculating section (moving average calculating section)
207: TCS_Ave storing section (moving average storing section)
208: TCS_B_Ave storing section (block average storing section)
300: Toner concentration control section
301: Gain adjusting section

The invention claimed is:

1. A method for determining a toner shortage for use in an image forming apparatus, said image forming apparatus comprising a developing device in which toner is supplied into a circulation carrying path through a toner supply inlet which is located in a part of the circulation carrying path in which developer, containing toner and magnetic carrier, is circulated and carried, said method determining that toner to be supplied has run short, by use of a sensor output of a magnetic permeability sensor which detects a magnetic permeability of the developer which is circulated and carried through the circulation carrying path, said method comprising the steps of:

carrying out a monitoring operation, in which (i) sensor outputs of the magnetic permeability sensor are periodically sampled, (ii) a time period, corresponding to one (1) circulation period which is required for the developer to be circulated once in the circulation carrying path, is evenly divided into a plurality of blocks, and (iii) an average of the sensor outputs in one (1) block time period corresponding to one (1) block is calculated for each of the plurality of blocks; and determining that the toner has run short, in a case where the number of times that the averages of the sensor outputs consecutively exceed a threshold becomes not less than the number of the plurality of blocks which correspond to the time period corresponding to one (1) circulation period, the threshold being set to be higher than a reference value of the sensor outputs of the magnetic permeability sensor.

2. The method as set forth in claim 1, wherein:

a time width of each of the plurality of blocks is set (i) so as to eliminate noise and (ii) such that, in a case where toner is supplied while the averages of the sensor outputs are consecutively exceeding the threshold, an average, obtained by calculation based on sampled sensor outputs of the magnetic permeability sensor which has detected a magnetic permeability of the developer in a region where supplied toner is unevenly distributed, becomes not more than the threshold.

3. The method as set forth in claim 2, wherein:

the time width of each of the plurality of blocks is further set such that the average which is not more than the threshold is consecutively calculated a plurality of times.

4. The method as set forth in claim 1, wherein:

the threshold is set as an additional value to be added to the reference value of the sensor outputs of the magnetic permeability sensor;

the number of blocks, based on which toner shortage is determined, is set to be small when the additional value is high; and the number of blocks, based on which the toner shortage is determined, is set to be large when the additional value is low.

5. An image forming apparatus, comprising:

a developing device which includes (i) a developer storing section in which developer containing toner and magnetic carrier is stored, (ii) a developer carrying member which stirs and carries the developer so as to circulate the developer in the developer storing section, (iii) a developing roller which supplies the toner contained in the developer to a photoreceptor drum, and (iv) a toner supply inlet through which toner is supplied into the developer storing section, the toner supply inlet being located in a part of a circulation carrying path in the developer storing section;

a toner supply device which supplies toner to the developing device;

a magnetic permeability sensor which detects a magnetic permeability of the developer which is circulated and carried in the developer storing section by the developer carrying member; and a monitoring/detecting section which periodically samples an output of the magnetic permeability sensor so as to detect toner shortage in the toner supply device based on a sampled output, the monitoring/detecting section including:

a block average calculating section which (i) periodically samples sensor outputs of the magnetic permeability sensor, (ii) evenly divides, into a plurality of blocks, a time period corresponding to one (1) circulation period which is required for the developer to be circulated once in the circulation carrying path, and (iii) calculates an average of the sensor outputs in one (1) block time period corresponding to one (1) block for each of the plurality of blocks, a measuring section which measures the number of times that block averages, calculated by the block average calculating section, have consecutively exceeded a threshold which is an addition of a predetermined value and a reference value of the sensor outputs of the magnetic permeability sensor, and a toner shortage determining section which determines that the toner has run short, in a case where the number of times that the measuring section has measured reaches a predetermined determination value which is not less than the number of the plurality of blocks which correspond to the time period corresponding to one (1) circulation period.

6. The image forming apparatus as set forth in claim 5, wherein:

each of the plurality of blocks is set (i) so as to eliminate a noise and (ii) such that, in a case where toner is supplied while the averages of the sensor outputs are consecutively exceeding the threshold, an average, obtained by calculation based on sampled sensor outputs of the magnetic permeability sensor which has detected a magnetic permeability of the developer in a region where supplied toner is unevenly distributed, becomes not more than the threshold.

7. The image forming apparatus as set forth in claim 6, wherein:

each of the plurality of blocks is further set such that the average which is not more than the threshold is consecutively calculated a plurality of times.

8. The image forming apparatus as set forth in claim 5, wherein:

the number of blocks, based on which toner shortage is determined, is set to be small when the threshold is high; and the number of blocks, based on which the toner shortage is determined, is set to be large when the threshold is low.

9. The image forming apparatus as set forth in claim 8, wherein:

the measuring section measures each number of times that block averages consecutively exceed a corresponding one of a plurality of thresholds; and the toner shortage determining section determines that toner has run short, in a case where any of the numbers of times that the measuring section has measured for respective thresholds reaches a corresponding one of a plurality of determination values which are set for the respective plurality of determination values.

10. The image forming apparatus as set forth in claim 5, further comprising:

a threshold changing section which changes the threshold so that the threshold becomes near the reference value, when an amount of toner remaining in the toner supply device becomes not more than a predetermined amount.

11. The image forming apparatus as set forth in claim 5, further comprising:

a one-rotation average calculating section which (i) samples sensor outputs of the magnetic permeability sensor at predetermined time intervals each of which is shorter than a time period corresponding to one (1) rotation period required for the developer carrying member to rotate once and (ii) calculates, based on sampled sensor outputs, a one-rotation average each time the developer carrying member rotates, the one-rotation average being an average of the sensor outputs of the magnetic permeability sensor for the time period corresponding to one (1) rotation period, the block average calculating section calculating, as the block average, an average of a predetermined number of one-rotation averages.

12. The image forming apparatus as set forth in claim 5, wherein:

the monitoring/detecting section further includes:

a moving average calculating section which calculates a moving average by periodically sampling the sensor outputs of the magnetic permeability sensor, the moving average being calculated for each time period not shorter than the time period corresponding to the one (1) circulation period; and a first gain adjusting section which adjusts, when image quality is adjusted, a control voltage applied to the magnetic permeability sensor such that the moving average becomes equal to the reference value.

13. The image forming apparatus as set forth in claim 12, wherein:

the moving average calculating section calculates a moving average based on block averages calculated by the block average calculating section.

14. The image forming apparatus as set forth in claim 12, further comprising:

a moving average storing section which controls a nonvolatile memory to store a moving average calculated by the moving average calculating section.

15. The image forming apparatus as set forth in claim 14, wherein:

the moving average is stored in the nonvolatile memory in the form of quotient and remainder.

16. The image forming apparatus as set forth in claim 5, wherein:

the monitoring/detecting section further includes:

a block average storing section which controls, every time a job is ended, a nonvolatile memory to store a latest block average calculated by the block average calculating section; and a second gain adjusting section which (i) samples, when a processing speed is changed, the sensor outputs of the magnetic permeability sensor and (ii) adjusts a control voltage, which is applied to the magnetic permeability sensor, so that an average of sampled sensor outputs becomes equal to the latest block average stored in the block average storing section.

* * * * *